US007405360B2

(12) United States Patent
Clark et al.

(10) Patent No.: US 7,405,360 B2
(45) **Date of Patent: *Jul. 29, 2008**

(54) DATA CABLE WITH CROSS-TWIST CABLED CORE PROFILE

(75) Inventors: William T. Clark, Leominster, MA (US); Galen M. Gareis, Oxford, OH (US)

(73) Assignee: Belden Technologies, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/673,357

(22) Filed: Feb. 9, 2007

(65) Prior Publication Data

US 2007/0193769 A1 Aug. 23, 2007

Related U.S. Application Data

(63) Continuation-in-part of application No. 11/584,825, filed on Oct. 23, 2006, which is a continuation of application No. 11/445,448, filed on Jun. 1, 2006, which is a continuation of application No. 11/197,718, filed on Aug. 4, 2005, now Pat. No. 7,135,641, which is a continuation of application No. 10/705,672, filed on Nov. 10, 2003, now Pat. No. 7,154,043, which is a continuation-in-part of application No. 10/430,365, filed on May 5, 2003, now abandoned, which is a continuation of application No. 09/532,837, filed on Mar. 21, 2000, now Pat. No. 6,596,944, which is a continuation of application No. 08/841,440, filed on Apr. 22, 1997, now Pat. No. 6,074,503.

(51) Int. Cl.
*H01B 7/00* (2006.01)

(52) U.S. Cl. ..... 174/113 R; 174/113 AS; 174/113 C

(58) Field of Classification Search ..... 174/110 R, 174/113 R, 115, 116, 120 R, 120 SR, 113 C
See application file for complete search history.

(56) References Cited

U.S. PATENT DOCUMENTS 1,008,370 A 11/1911 Robillot (Continued)

FOREIGN PATENT DOCUMENTS

CA 1164064 3/1984

(Continued)

OTHER PUBLICATIONS

International Search Report from International Application PCT/US2006/047113.

*Primary Examiner*—William H. Mayo, III
(74) *Attorney, Agent, or Firm*—Lowrie, Lando & Anastasi, LLP

(57) ABSTRACT

Cables including a plurality of twisted pairs of insulated conductors and a jacket surrounding the plurality of twisted pairs of insulated conductors, the jacket including a plurality of protrusions extending away from an inner circumferential surface of the jacket toward a center of the cable. The plurality of protrusions are configured so as to hold the plurality of twisted pairs away from the inner circumferential surface of the jacket, and may provide an air gap between the plurality of twisted pairs of insulated conductors and the inner circumferential surface of the jacket.

27 Claims, 18 Drawing Sheets

U.S. PATENT DOCUMENTS 1,132,452 A 3/1915 Davis
1,700,606 A 1/1929 Beaver
1,940,917 A 12/1933 Okazaki
1,977,209 A 10/1934 Sargent
1,995,201 A 3/1935 Delon
2,218,830 A 10/1940 Rose et al.
2,501,457 A 3/1950 Thelin
3,259,687 A 7/1966 Oatess et al.
3,328,510 A 6/1967 White
3,489,844 A 1/1970 Motley
3,603,715 A 9/1971 Vinnhorst et al.
3,644,659 A 2/1972 Campbell
3,881,052 A 4/1975 Britz et al.
3,945,974 A 3/1976 Schwarcz et al.
3,999,003 A 12/1976 Chevrolet et al.
4,034,148 A 7/1977 Lang
4,319,940 A 3/1982 Arroyo et al.
4,401,845 A 8/1983 Odher et al.
4,412,094 A 10/1983 Dougherty et al.
4,487,992 A 12/1984 Tomita
4,654,476 A 3/1987 Barnicol-Ottler et al.
4,697,051 A 9/1987 Beggs et al.
4,777,325 A 10/1988 Siwinski
4,778,246 A 10/1988 Carroll
4,784,462 A 11/1988 Priaroggia
4,804,702 A 2/1989 Bartoszwk
4,873,393 A 10/1989 Friesen et al.
5,073,682 A 12/1991 Walling et al.
5,077,449 A 12/1991 Cornibert et al.
5,097,099 A 3/1992 Miller
5,107,076 A 4/1992 Bullock et al.
5,132,488 A 7/1992 Tessier et al.
5,132,491 A 7/1992 Mulrooney et al.
5,149,915 A 9/1992 Brunker et al.
5,155,304 A 10/1992 Gossett et al.
5,180,890 A 1/1993 Pendergrass et al.
5,424,491 A 6/1995 Walling et al.
5,434,354 A 7/1995 Baker et al.
5,493,071 A 2/1996 Newmoyer et al.
5,514,837 A 5/1996 Kenny et al.
5,563,377 A 10/1996 Arpin et al.
5,574,250 A 11/1996 Hardie et al.
5,606,151 A 2/1997 Siekierka et al.
5,619,016 A 4/1997 Newmoyer
5,658,406 A 8/1997 Walling et al.
5,698,323 A 12/1997 Keough et al.
5,699,467 A 12/1997 Kojima et al.
5,789,711 A * 8/1998 Gaeris et al. ..... 174/113 C
5,821,467 A 10/1998 O'Brien et al.
5,834,697 A 11/1998 Baker et al.
5,841,072 A 11/1998 Gagnon et al.
5,883,334 A 3/1999 Newmoyer et al.
5,936,205 A 8/1999 Newmoyer
5,952,607 A 9/1999 Friesen et al.
5,952,615 A 9/1999 Prudhon
5,956,445 A 9/1999 Deitz, Sr. et al.
5,969,295 A 10/1999 Boucino et al.
6,037,546 A 3/2000 Mottine et al.
6,091,025 A 7/2000 Cotter et al.
6,140,587 A 10/2000 Sackett
6,150,612 A 11/2000 Grandy et al.
6,162,992 A 12/2000 Clark et al.
6,222,129 B1 4/2001 Sierkerka et al.
6,222,130 B1 * 4/2001 Gareis et al. ..... 174/113 C
6,248,954 B1 6/2001 Clark et al.
6,272,858 B1 8/2001 Walling et al.
6,297,454 B1 10/2001 Gareis
6,300,573 B1 10/2001 Horie et al.
6,303,867 B1 10/2001 Clark et al.
6,310,295 B1 10/2001 Despard
6,365,836 B1 4/2002 Blouin et al.
6,378,283 B1 4/2002 Barton
6,392,152 B1 5/2002 Mottine, Jr. et al.
6,441,308 B1 8/2002 Gagnon et al.
6,566,607 B1 5/2003 Walling
6,570,095 B2 5/2003 Clark et al.
6,596,944 B1 7/2003 Clark et al.
6,639,152 B2 10/2003 Glew et al.
6,800,811 B1 10/2004 Boucino et al.
6,812,408 B2 11/2004 Clark et al.
6,818,832 B2 11/2004 Hopkinson et al.
6,888,070 B1 5/2005 Prescott
7,135,641 B2 * 11/2006 Clark ..... 174/110 R
7,145,080 B1 * 12/2006 Boisvert et al. ..... 174/110 R
7,154,043 B2 * 12/2006 Clark ..... 174/113 R
2002/0050394 A1 5/2002 Clark et al.
2004/0050578 A1 3/2004 Hudson
2004/0055777 A1 * 3/2004 Wiekhorst et al. ..... 174/110 R
2005/0051355 A1 * 3/2005 Bricker et al. ..... 174/113 R
2005/0092515 A1 5/2005 Kenny et al.
2005/0133246 A1 * 6/2005 Parke et al. ..... 174/113 R
2006/0032660 A1 2/2006 Parke et al.
2006/0131058 A1 6/2006 Lique et al.
2006/0243477 A1 11/2006 Jean et al.

FOREIGN PATENT DOCUMENTS

DE 697378 10/1940
DE 90 11 484.1 U1 11/1990
DE 43 36 230 C1 3/1995
EP 0961296 12/1999
EP 1 087 410 A2 9/2000
EP 1085530 A2 3/2001
EP 1162632 A2 12/2001
EP 1548754 A2 6/2005
EP 1130604 A2 9/2005
FR 2706068 12/1994
GB 342606 2/1931
GB 725624 3/1955
GB 2260216 A 4/1993
WO 9848430 10/1998
WO 0051142 8/2000
WO 0154142 7/2001
WO 0193281 12/2001
WO WO 03077265 A 9/2003
WO 2005041219 5/2005

* cited by examiner

DATA CABLE WITH CROSS-TWIST CABLED CORE PROFILE

RELATED APPLICATIONS

This application is a continuation-in-part of and claims priority under 35 U.S.C. § 120 to pending U.S. application Ser. No. 11/584,825 entitled "Data Cable with Cross-Twist Cabled Core Profile," filed on Oct. 23, 2006 which is a continuation of, and claims priority under 35 U.S.C. § 120 to, pending U.S. application Ser. No. 11/445,448, entitled "Data Cable with Cross-Twist Cabled Core," filed on Jun. 1, 2006 which is a continuation of, and claims priority under 35 U.S.C. § 120 to, U.S. application Ser. No. 11/197,718 entitled "Data Cable With Cross-Twist Cabled Core Profile," filed on Aug. 4, 2005, now U.S. Pat. No. 7,135,641 which is a continuation of, and claims priority under 35 U.S.C. § 120 to, U.S. application Ser. No. 10/705,672 entitled "Data Cable With Cross-Twist Cabled Core Profile," filed on Nov. 10, 2003, now U.S. Pat. No. 7,154,043 which is a continuation-in-part of, and claims priority under 35 U.S.C. § 120 to, U.S. application Ser. No. 10/430,365 entitled "Enhanced Data Cable With Cross-Twist Cabled Core Profile," filed May 5, 2003, now abandoned, which is a continuation of, and claims priority under 35 U.S.C. § 120 to, U.S. application Ser. No. 09/532,837 entitled "Enhanced Data Cable With Cross-Twist Cabled Core Profile," filed on Mar. 21, 2000, now U.S. Pat. No. 6,596,944 which is a continuation of, and claims priority under 35 U.S.C. § 120 to, U.S. application Ser. No. 08/841,440, filed Apr. 22, 1997 entitled "Making Enhanced Data Cable with Cross-Twist Cabled Core Profile" (as amended) now U.S. Pat. No. 6,074,503, each of which is herein incorporated by reference in its entirety.

BACKGROUND

1. Field of Invention

The present invention relates to high-speed data communications cables. More particularly, it relates to cables including shaped separators and jackets.

2. Discussion of Related Art

High-speed data communications media include pairs of wire twisted together to form a balanced transmission line. Such pairs of wire are referred to as twisted pairs. One common type of conventional cable for high-speed data communications includes multiple twisted pairs that may be bundled and twisted (cabled) together then covered with a jacket to form the cable.

Modern communication cables must meet electrical performance characteristics required for transmission at high frequencies. When twisted pairs are closely placed, as may be the case in a multi-pair cable, electrical energy may be transferred from one twisted pair to another. Such energy transferred between pairs is referred to as crosstalk and is generally undesirable. Crosstalk causes interference to the information being transmitted through the twisted pair(s) and can reduce the data transmission rate and cause an increase in the bit error rate. The Telecommunications Industry Association and the Electronics Industry Association (TIA/EIA) have developed standards which specify specific categories of performance for cable impedance, attenuation, skew and crosstalk isolation. The International Electrotechnical Commission (IEC) has also defined standards for data communication cable crosstalk, including ISO/IEC 11801. One high-performance standard for 100Ω cable is ISO/IEC 11801, Category 5; another is ISO/IEC 11801 Category 6.

In twisted pairs, the rate of twist is defined as a specified distance between twists along the longitudinal direction, that distance being referred to as the pair lay or twist lay. When adjacent twisted pairs have the same pair lay and/or twist direction, they tend to lie within a cable more closely spaced than when they have different pair lays and/or twist direction. Such close spacing may increase the amount of undesirable crosstalk which occurs between adjacent pairs. Therefore, twisted pairs within a cable are sometimes given unique pair lays so as to reduce the crosstalk between twisted pairs of a cable. Twist direction may also be varied. Along with varying pair lays and twist directions, individual solid metal or woven metal pair shields are sometimes used to electromagnetically isolate pairs from one another.

In some cables, a separator is used to separate one twisted pair from another to improve crosstalk between the pairs and/or to provide added structural stability to the cable. For example, referring to FIG. 1, there is illustrated an example of a cable 100 including a plurality of twisted pairs 103 and a conventional separator 200. The twisted pairs 103 are spaced about the separator 200 which provides physical separation among the pairs. The separator can also provide structural stability to the cable. Generally, the separator 200 comprises a solid, round rod, as illustrated, and may be made of a suitable dielectric material. The cable may be finished with a jacket 202 provided around the twisted pairs 103 and the separator 200.

In building design, many precautions are taken to resist the spread of flame and the generation of and spread of smoke throughout a building in case of an outbreak of fire. Clearly, it is desired to protect against loss of life and also to minimize the costs of a fire due to the destruction of electrical and other equipment. Therefore, wires and cables for in building installations are required to comply with the various flammability requirements of the National Electrical Code (NEC) and/or the Canadian Electrical Code (CEC).

Cables intended for installation in the air handling spaces (i.e. plenums, ducts, etc.) of buildings are specifically required by NEC or CEC to pass the flame test specified by Underwriters Laboratories Inc. (UL), UL-910, or its Canadian Standards Association (CSA) equivalent, the FT6. The UL-910 and the FT6 represent the top of the fire rating hierarchy established by the NEC and CEC respectively. Cables possessing this rating, generically known as "plenum" or "plenum rated", may be substituted for cables having a lower rating (i.e. CMR, CM, CMX, FT4, FT1 or their equivalents), while lower rated cables may not be used where plenum rated cable is required. Cables conforming to NEC or CEC requirements are characterized as possessing superior resistance to ignitability, greater resistant to contribute to flame spread and generate lower levels of smoke during fires than cables having a lower fire rating. Conventional designs of data grade telecommunications cables for installation in plenum chambers have a low smoke generating jacket material, e.g. of a PVC formulation or a fluoropolymer material, surrounding a core of twisted conductor pairs, each conductor individually insulated with a fluorinated ethylene propylene (FEP) insulation layer. Cable produced as described above satisfies recognized plenum test requirements such as the "peak smoke" and "average smoke" requirements of the Underwriters Laboratories, Inc., UL910 Steiner test and/or Canadian Standards Association CSA-FT6 (Plenum Flame Test) while also achieving desired electrical performance in accordance with EIA/TIA-568A for high frequency signal transmission.

SUMMARY OF INVENTION

Aspects and embodiments of the invention are directed to cables for data transmission that have constructions that may reduce alien crosstalk and/or may improve data transmission performance of the cable as compared to conventional cables. In one embodiment, a cable may comprise a plurality of twisted pairs of insulated conductors including a first twisted pair and a second twisted pair, each twisted pair comprising two insulated conductors twisted together in a helical manner, a binder substantially surrounding the plurality of twisted pairs of insulated conductors, a jacket surrounding the plurality of twisted pairs of insulated conductors and the binder, and an element disposed between the binder and the jacket along a length of the cable, the element providing an air gap between the jacket and the binder. The element may comprise, for example, one or more dielectric helixed splines (made of any of a variety of materials, including, for example, a fluoropolymer) or a conductive rod. The element(s) may be about a circumference of the binder or may be helically wrapped about the binder. In one example, the cable may further a separator disposed among the plurality of twisted pairs of insulated conductors so as to separate at least one the plurality of twisted pairs from others of the plurality of twisted pairs.

According to one embodiment, a cable for data transmission may comprise a plurality of twisted pairs of insulated conductors including a first twisted pair and a second twisted pair, each twisted pair comprising two insulated conductors helically twisted together, a separator disposed among the plurality of twisted pairs of insulated conductors so as to separate at least one the plurality of twisted pairs from others of the plurality of twisted pairs, and a jacket surrounding the plurality of twisted pairs and the separator, wherein the jacket comprises a plurality of inwardly-projecting protrusions that extend away from an inner circumferential surface of the jacket toward the plurality of twisted pairs of insulated conductors.

In one example, the jacket may comprise a dual-layer structure including a first jacket layer and a second jacket layer, and wherein the plurality of protrusions extends away from an inner circumferential surface of the first jacket layer. In another example, a conductive shield may be disposed between the first jacket layer and the second jacket layer. The first jacket layer may comprise, for example, a first material having a first effective dielectric constant and the second jacket layer comprise, for example, a second material having a second effective dielectric constant; and wherein the first effective dielectric constant is lower than the second effective dielectric constant. In addition, or alternatively, the first jacket layer may comprise a first material having a first dissipation factor and the second jacket layer may comprise a second material having a second dissipation factor; and wherein the first dissipation factor is lower than the second dissipation factor. In one embodiment, the cable may further comprise a dielectric element, for example, a helixed spline, disposed between the first jacket layer and the second jacket layer to create an air gap between the first and second jacket layers. In another example, the first jacket layer may be bonded to the second jacket layer.

In another example, the cable jacket may comprise a dual-layer structure including a first jacket layer and a second jacket layer, and wherein the plurality of protrusions extend away from an inner circumferential surface of the second jacket layer to create an air gap between the first and second jacket layers. The first jacket layer may comprise a first material and the second jacket layer may comprise a second material, wherein at least one of an effective dielectric and a dissipation factor is lower for the first material than for the second material. In one example, the first jacket layer may comprise a foamed material. In one embodiment, the plurality of inwardly-projecting protrusions may include at least a first inwardly-projecting protrusion and a second inwardly-projecting protrusion; and wherein the first inwardly-projecting protrusion has a first height and the second inwardly-projecting protrusion has a second height that is substantially larger than the first height. In another embodiment, the plurality of inwardly-projecting protrusions may include at least a first inwardly-projecting protrusion and a second inwardly-projecting protrusion; and wherein the first inwardly-projecting protrusion has a first width and the second inwardly-projecting protrusion has a second width that is substantially larger than the first width.

Another embodiment of a cable may comprise a plurality of twisted pairs of insulated conductors including a first twisted pair and a second twisted pair, each twisted pair comprising two insulated conductors helically twisted together, a helixed spline comprising a plurality of fins extending outwardly from a central connection point to create a plurality of channels, each channel being defined by a pair of fins, the helixed spline having a substantially dielectric body, and the fins each having a base connected to the central connection point and a tip, and a conductive layer disposed on the tips of the fins, wherein the twisted pairs of insulated conductors are disposed at least partially within the plurality of channels. In one example, the cable may further comprise a conductive shield substantially surrounding the plurality of twisted pairs of insulated conductors and the helixed spline; wherein the conductive layer is in contact with the conductive shield at least at some points along a length of the cable.

BRIEF DESCRIPTION OF DRAWINGS

In the drawings, which are not intended to be drawn to scale, each identical or nearly identical component that is illustrated in various figures is represented by a like numeral. For purposes of clarity, not every component may be labeled in every drawing. The drawings are provided for the purposes of illustration and explanation and are not intended as a definition of the limits of the invention. In the drawings.

DETAILED DESCRIPTION

Figure 1:
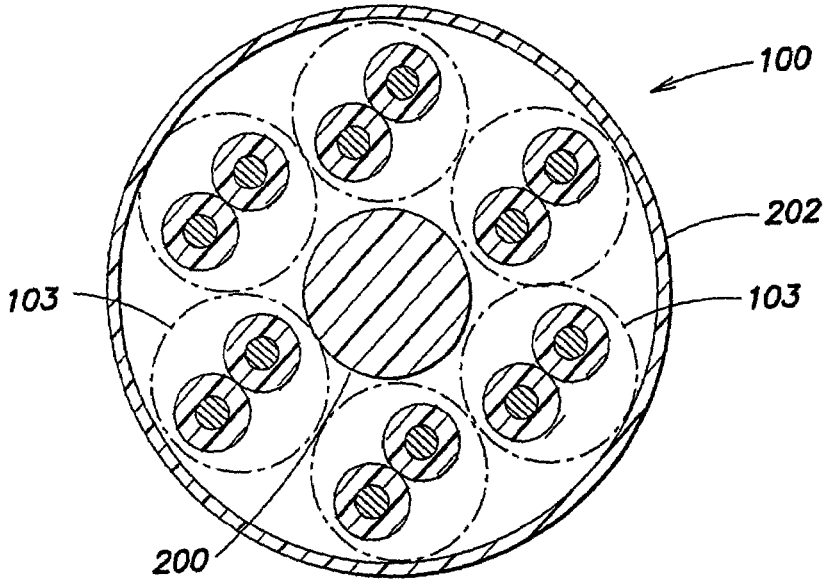
FIG. 1 PRIOR ART
FIG. 1 is a diagram of a conventional cable.

Aspects and embodiments of the invention are directed to twisted pair communication cables that may exhibit superior transmission properties through the use of structures which may reduce alien crosstalk, internal crosstalk and signal attenuation in the twisted pairs. Various illustrative embodiments and aspects thereof are described in detail below with reference to the accompanying figures. It is to be appreciated that this invention is not limited in its application to the details of construction and the arrangement of components set forth in the following description or illustrated in the drawings. The invention is capable of other embodiments and of being practiced or of being carried out in various ways. Examples of specific implementations are provided herein for illustrative purposes only and are not intended to be limiting. In particular, acts, elements and features discussed in connection with one embodiment are not intended to be excluded from a similar role in other embodiments. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

Figure 2:
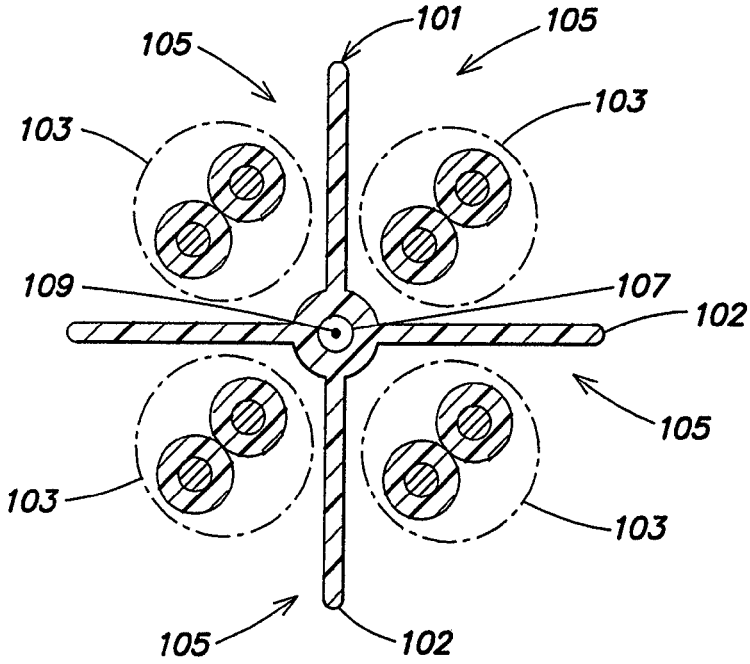
FIG. 2 is a cross-sectional view of a cable core according to one embodiment of the invention.

Referring to FIG. 2, there is illustrated a portion of one embodiment of a cable including an extruded core 101 having a profile described below cabled into the cable with four twisted pairs 103. Although the following description will refer primarily to a cable that is constructed to include four twisted pairs of insulated conductors and a core having a unique profile, it is to be appreciated that the invention is not limited to the number of pairs or the profile used in this embodiment. The inventive principles can be applied to cables including greater or fewer numbers of twisted pairs and different core profiles. Also, although this embodiment of the invention is described and illustrated in connection with twisted pair data communication media, other high-speed data communication media can be used in constructions of cable according to the invention. In addition, it is to be appreciated that the term "core" is used synonymously herein with the term "separator" and is intended to refer to an element that may be included in a jacketed cable to separate at least one transmission medium (e.g., a twisted pair of insulated conductors) from at least one other transmission medium and/or from the cable jacket.

As shown in FIG. 2, according to one embodiment of the invention, the extruded core profile may have an initial shape of a "+", providing four spaces or channels 105, one between each pair of fins 102 of the core 101. Each channel 105 carries one twisted pair 103 placed within the channel 105 during the cabling operation. The illustrated core 101 and profile should not be considered limiting. The core 101 may be made by some other process than extrusion and may have a different initial shape or number of channels 105. For example, as illustrated in FIG. 2, the core may be provided with an optional central channel 107 that may carry, for example, an optical fiber element or strength element 109. In addition, in some examples, more than one twisted pair 103 may be placed in each channel 105.

Embodiments of the above-described separator can be constructed using a number of different materials. While the invention is not limited to the materials now given, the invention may be advantageously practiced using these materials in some circumstances. In one embodiment, particularly for use in shielded cables, the core material may include a conductive material. For example, the core may include a metallic or other conductive coating over a dielectric body. In another example, a filler may be added to the core compound to render the extruded product conductive. The core compound may include any material generally compatible with use in data communications cable applications, including any applicable fire safety standards. Suitable fillers are those compatible with the compound into which they are mixed, including but not limited to powdered ferrite, semiconductive thermoplastic elastomers and carbon black. Conductivity of the core helps to further isolate the twisted pairs from each other and may be particularly useful in cables including a shield layer, as discussed below. In non-plenum applications, the core may be formed of solid or foamed flame retardant polyolefin or similar materials. The core may also be formed of non-flame retardant materials. In plenum applications, the core can be, for example, any one or more of the following compounds: a solid low dielectric constant fluoropolymer, e.g., ethylene chlortrifluoroethylene (E-CTFE), MFA or fluorinated ethylene propylene (FEP) or material in the FEP family, a foamed fluoropolymer, e.g., foamed FEP, or foamed MFA, and polyvinyl chloride (PVC) in either solid, low dielectric constant form or foamed. It is to be appreciated that the term FEP as used herein is intended to refer not only to fluorinated ethylene propylene, but also to all materials in its family. Similarly, it is to be understood that where examples of other materials (e.g., PVC) are given herein, the intent is to include all similar and/or related materials that may be used interchangeably with the example material.

Figure 3:
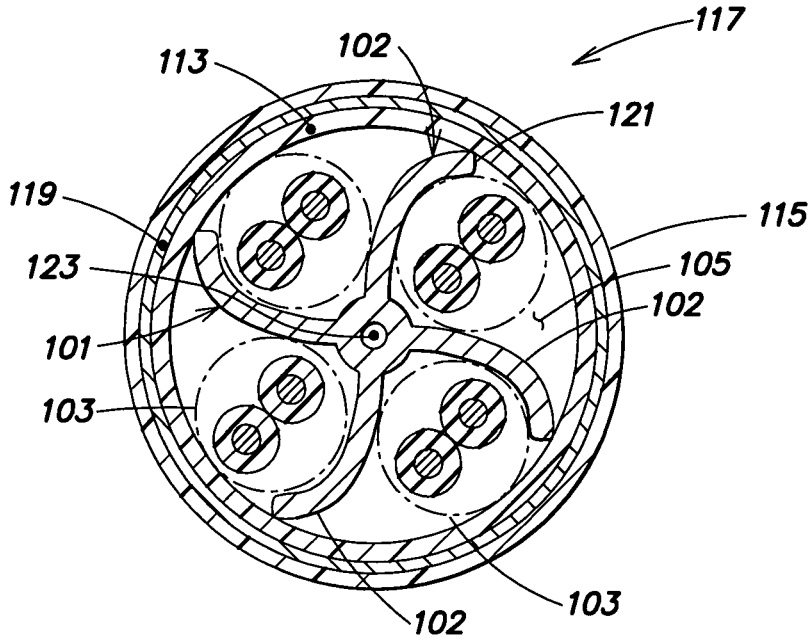
FIG. 3 is a cross-sectional view of one embodiment of a cable including the core of FIG. 2.

The cable may be completed in any one of several ways, for example, as shown in FIG. 3. The combined core 101 and twisted pairs 103 may be optionally wrapped with a binder 113 and then jacketed with a jacket 115 to form cable 117. In one example, an overall conductive shield 119 can optionally be applied over the binder 113 before jacketing to prevent the cable from causing or receiving electromagnetic interference. The jacket 115 may comprise, for example, PVC or any of the materials discussed above in relation to the core 101. The binder 113 may be, for example, a dielectric tape which may be polyester, or another compound generally compatible with data communications cable applications, including any applicable fire safety standards. It is to be appreciated that the cable can be completed without either or both of the binder and the conductive shield 119, for example, by providing the jacket 115. Further embodiments of jackets that may be used to finish a cable are discussed below.

As is known in this art, when plural elements are cabled together, an overall twist is imparted to the assembly to improve geometric stability and help prevent separation. In some embodiments of a process of manufacturing the cable of the invention, twisting of the profile of the core along with the individual twisted pairs is controlled. The process may include providing the extruded core to maintain a physical spacing between the twisted pairs and to maintain geometrical stability within the cable. Thus, the process assists in the achievement of and maintenance of high crosstalk isolation by placing a conductive or non-conductive core in the cable to maintain pair spacing.

Figure 4:
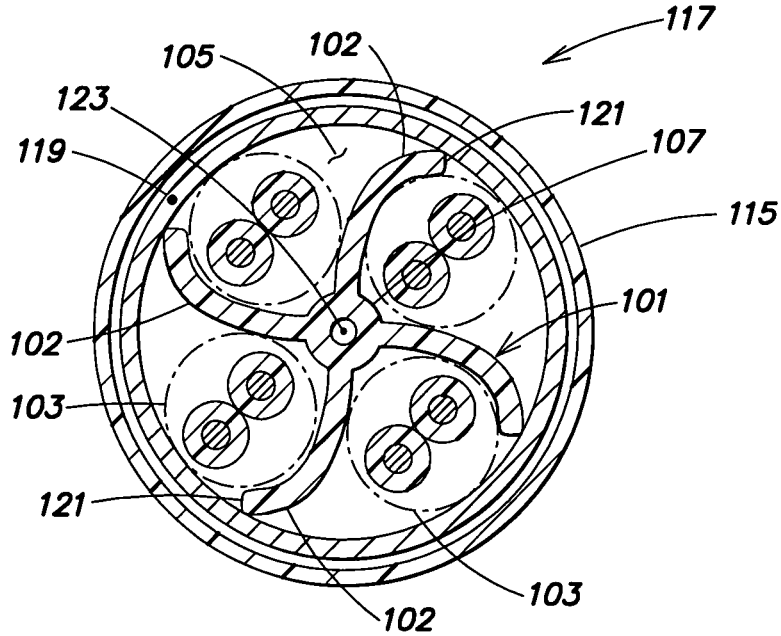
FIG. 4 is a cross-sectional view of another embodiment of a cable including the core of FIG. 2.

According to another embodiment, greater cross-talk isolation may achieved in the construction of FIG. 4 by using a conductive shield 119, for example a metal braid, a solid metal foil shield or a conductive plastic layer in contact with the ends 121 of the fins 102 of the core 101. In one such embodiment, the core is preferably conductive. In another embodiment, the core 101 may be substantially dielectric, but may include a conductive coating on the tips 121, such that the conductive tips may be in contact with the conductive shield layer 119. In one example, a discontinuous conductive layer or shield may be embedded within or disposed along a portion of the tips 121. In these embodiments, the shield 119 may be wrapped around the core 101 and the twisted pairs such that the fins 102 partially bend or fold over the twisted pairs, as shown in FIG. 4, and such that the tips of the fins contact the shield. Such a construction rivals individual shielding of twisted pairs for cross-talk isolation. In one embodiment, this construction optionally can advantageously include a drain wire 123 disposed in the central channel 107, as illustrated in FIG. 4. As discussed above, in some examples, it may be advantageous to have the fins 102 of the core 101 extend somewhat beyond a boundary defined by the outer dimension of the twisted pairs 103. As shown in FIG. 4, this helps to ensure that the twisted pairs 103 do not escape their respective channels 105 prior to the cable being jacketed, and may also facilitate good contact between the fins 102 and the shield 119. In the illustrated example, closing and jacketing the cable 117 may bend the ends 121 of the fins 102 over slightly, as shown, if the core material is a relatively soft material, such as PVC or a similar compound.

Figure 5:
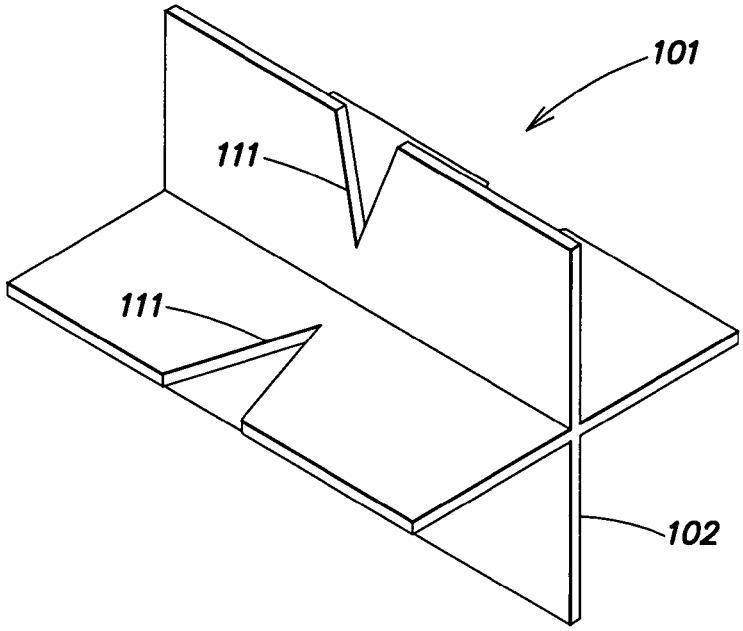
FIG. 5 is perspective view of one embodiment of a perforated core according to the invention.

As discussed above, the core 101 may have a variety of different profiles and may be conductive or non-conductive. According to one embodiment, the core 101 may further include features that may facilitate removal of the core 101 from the cable. For example, referring to FIG. 5, the core 101 may be provided with narrowed, or notched, sections 111, which are referred to herein as "pinch points." At the notched sections, or pinch points, a diameter or size of the core 101 is reduced compared with the normal size of the core 101 (at the non-pinch point sections of the core). Thus, the pinch points 111 provide points at which it may be relatively easy to break the core 101. The pinch points 111 may act as "perforations" along the length of the core, facilitating snapping of the core at these points, which in turn may facilitate removal of sections of the core 101 from the cable. This may be advantageous for being able to easily snap the core to facilitate terminating the cable with, for example, a telephone or data jack or plug. In one example, the pinch points 111 may be placed at intervals of approximately 0.5 inches along the length of the cable. The pinch points 111 should be small enough such that the twisted pairs may ride over the pinch points 111 substantially without dipping closer together through the notched sections 111. In one example, the pinch points may be formed during extrusion of the core by stretching the core for a relatively short period of time each time it is desired to form a pinch point 111. Stretching the core during extrusion results in "thinned" or narrowed sections being created in the core, which form the pinch points 111.

Figure 6:
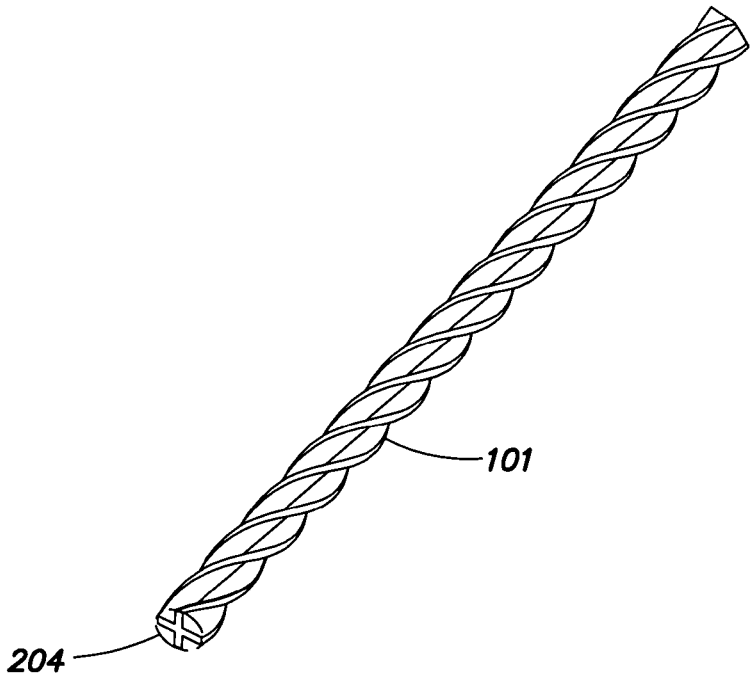
FIG. 6 is a perspective view of one embodiment of a separator according to the invention.

According to another embodiment, the core 101 may comprise a helixed spline, as illustrated in FIG. 6. Such a helixed spline may provide several advantages over conventional round; solid separators such as the separator 200 illustrated FIG. 1. Conventional round, solid fillers are generally inflexible and stiff by nature and displace a relatively large amount of air from the cable. If a conventional cable needed to be flexible, a very soft, often very flammable material was used for the separator or, alternatively, a textile or "slit film" separator was used. These provide little crush resistance or electrical stability if used as central separators in a cable. In addition, the large volume of the conventional separator can make meeting applicable fire safety regulations or the standards for "plenum-rated" cables more difficult. By contrast, a helixed spline core according to embodiments of the invention may provide improved flexibility over a conventional solid, round separator while also providing strength and good dielectric properties.

Referring to FIG. 6, one embodiment of a helixed spline may include a finned or "+-shaped" core (such as is described above) that may be twisted with a very tight twist lay to form the helixed spline. It is to be appreciated that the invention is not limited to the use of a "+-shaped" core to form the helixed spline and any non-round shape may be used, including, for example, a finned core having more or fewer than four fins. The twisted form may have a substantially round profile, as indicated by circle 204 and may be used to provide spacing between transmission media, for example, as a central separator in a cable. However, comparing a helixed spline with a circle 204 of the same diameter as the outer diameter of a conventional solid round separator, the helixed spline may use substantially less material. As a result, the helixed spline may therefore also displace less air from the cable than does a conventional solid separator, for improved electrical properties.

It is known that the attenuation and propagation velocity of a signal through a twisted pair (or single conductor) is influenced by the dielectric constant of the insulation material of the twisted pair as well as by the dielectric constant of nearby elements, such as a separator or the cable jacket. Generally, the lower the effective dielectric constant of dielectrics in proximity to the transmission media, the better for electrical performance of the cable. The effective dielectric constant of a material depends on the thickness of the material as well as on the inherent characteristics of the material. A helixed spline according to embodiments of the invention may provide improved electrical properties (e.g., effect on signal propagation and attenuation in nearby twisted pairs) because, as mentioned above, it may displace less air than does a conventional solid round separator. In particular, referring to the embodiment illustrated in FIG. 6, air may be present in spaces between the ridges (formed by the fins of the spline). This air may serve to lower the effective dielectric constant of the spline compared to its solid counterpart, providing the benefits discussed above.

In one embodiment, the twist lay of the spline may be varied to fine tune electrical and physical properties of the core and the overall cable. For example, a shorter twist lay may provide a core with greater crush resistance and a longer lay may provide increased material savings and improved electrical properties. The twist lay may be selected depending on the application for which the spline is to be used. The diameter of the spline may also vary depending on the application. For example, where a spline may be used as a filler in the cable to facilitate maintaining the shape of the cable, e.g., to keep it geometrically round, the filler may be appropriately sized and twisted for this application. For example, in a six-pair cable in which the insulated conductors have an outer diameter of about 0.09 inches, the conductors may be cabled around a filler spline having a diameter of about 0.09 inches. In this case, the filler spline may have a twist lay tight enough to allow the spline to act as a solid round filler and may be less than about 1 inch, and in some applications, less than about 0.3 inches. Alternatively, where a spline may be used as a spacer between the cable core and the cable jacket, it may again be appropriately sized, for example, to reduce alien crosstalk, and have a diameter of about 0.04 inches and a twist lay of less than about 0.5 inches. It is to be appreciated that many other sizes and applications are also possible and the invention is not limited to these examples.

As mentioned above, a helixed spline may provide significant material savings compared to a conventional solid round filler. For comparison, assume a solid rod filler having a diameter of 0.08 inches. A helixed spline may be defined as having an X shape, with an outer diameter of 0.08 inches and each segment of the X having a thickness of 0.12 inches. This spline, not accounting for twist loss, would provide a material savings of about 64% compared to the conventional solid round filler of the same diameter.

According to one embodiment, a helixed spline such as described above may be formed by extrusion. For example, the helixed spline may be continuously extruded using a die having a shaped head and a material that can be extruded (e.g., an extrudable polymer). In one example, to form a spline that has a "cross-shape" and is twisted with a certain twist lay, as described above, an extrusion die may be used with a cross-head that can be rotated during extrusion to provide the twist lay. In one example, a die may be used that rotates alternately in a clockwise and anticlockwise direction, such that the spline may be extruded with an "S/Z" configuration, as is known in the art.

A helixed spline according to embodiments of the invention may offer a number of advantages through the relative (i.e., compared to its solid round counterpart) reduction in the amount of material needed to make the separator. For example, the cost of the cable may be reduced because the amount of material is reduced. This may be particularly significant is the core is made from, or includes, expensive materials such as FEP. In addition, reducing the volume of material in the cable may make it easier to meet applicable fire safety standards as well as the requirements for the cable to be plenum-rated In conventional cables, if the separator is made of a flammable material, a thick jacket may be needed to achieve the required flame performance. Even if the helixed spline is also made from or includes a flammable material, because the volume of material present is reduced, a thinner jacket may be used while still achieving the same or better flame performance. This may further reduce the cost of the cable as the volume of jacket material may also be reduced. The reduction in materials may also reduce the weight of the cable, which may be advantageous in terms of shipping costs and ease of handling.

Figure 7:
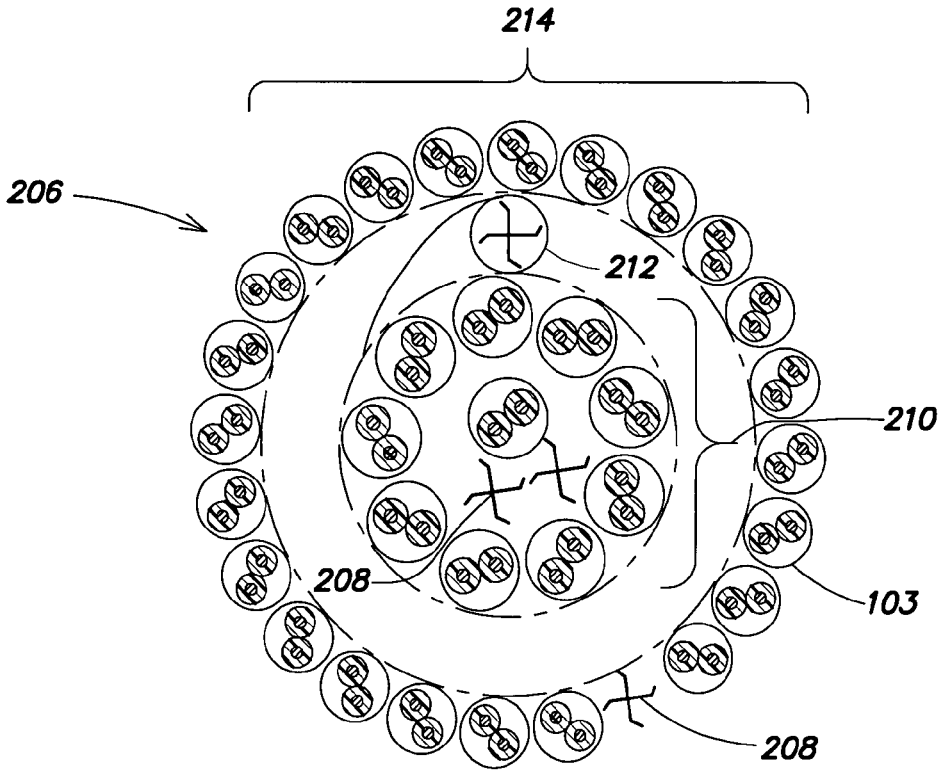
FIG. 7 is a diagram of another embodiment of a cable including the separator of FIG. 6, according to the invention.

According to another embodiment, a helixed spline such as described above may be used in as a separation barrier between layers of a multi-layer cable. One embodiment of a multi-layer cable 206 is illustrated in FIG. 7. The cable 206 may include a first layer 210 including a plurality of twisted pairs 103. The first layer may also include one or more separators 208 that may separate ones of the plurality of twisted pairs 103 from others of the plurality of twisted pairs 103. It is to be appreciated that these separators 208 may be helixed splines or may be any of the other core embodiments described herein. The multi-layer cable may further include a second layer 214 comprising another plurality of twisted pairs 103. The second layer may also include one or more separators 208 which may be, for example, helixed splines or any of the separator embodiments discussed above. A helixed spline 212 may be wrapped around the first layer to separate the first layer from the second layer. In this manner, the helixed spline 212 may act as an inner jacket layer, but may use substantially less material than would a conventional inner jacket. In addition, using a helixed spline instead of an inner jacket layer may provide the additional benefit of better electrical characteristics (e.g., decreased attenuation, increased velocity, etc.) due to the air that may be "trapped" between the ridges/fins of the spline, as discussed above.

Figure 8:
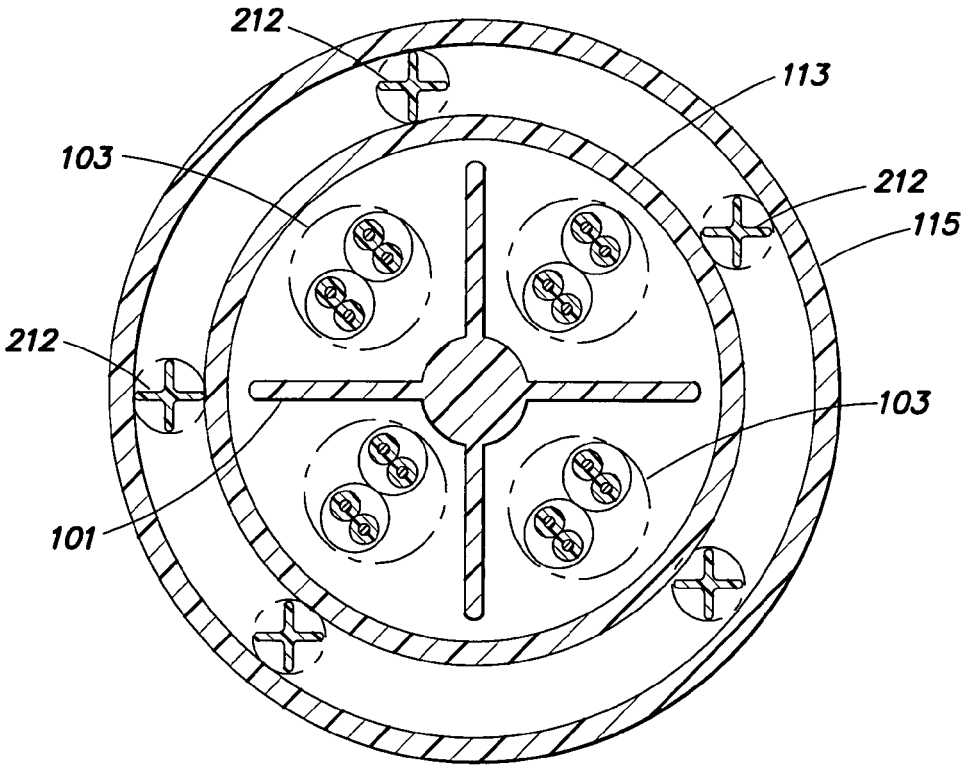
FIG. 8 is a cross-sectional diagram of another embodiment of a cable according to the invention.

Referring to FIG. 8, there is illustrated another embodiment of a cable including one or more helixed splines 212. The cable may include a plurality of twisted pairs which may optionally be separated from one another by a core 101, as shown. The core 101 and twisted pairs 103 may optionally be wrapped in a binder 113. A jacket 115 may be provided jacketing the core, twisted pairs and binder. In one embodiment, one or more helixed splines 212 may be provided between the binder 113 and the jacket 115. The spline(s) may be placed either helically (i.e., helically wrapped around the core and twisted pairs along the length of the cable) or longitudinally in the cable to provide a space or air gap between the twisted pairs 103 and the jacket 115. Whether the spline(s) are helically or longitudinally placed, they may serve to cause the jacket 115 to be held away from the twisted pairs (or binder 113), creating an air gap between the twisted pairs and the jacket. As a result of this air gap, the jacket material may have relatively less effect on the performance characteristics of the twisted pairs 103. For example, the twisted pairs may exhibit less attenuation due to increased air surrounding the twisted pairs 103. In addition, because the jacket 115 may be held further away from the twisted pairs 103 by the spline(s)

212, the spline(s) 212 may help to reduce alien crosstalk between adjacent cables. Alien crosstalk is known in the art and, as referred to herein, is intended to mean crosstalk interference occurring between data cables when near one another. In one example, providing the spline(s) may be substantially equivalent to providing a jacket with inwardly or outwardly projecting protrusions or fins, as is described below.

It is to be appreciated that the invention is not limited to the use of helixed splines and that in some embodiments, the helixed spline(s) 212 may be replaced by solid or foamed rods (having a round or other cross-sectional shape) that may perform the same functions described above. In addition, the invention is not limited to the construction illustrated in FIG. 8 which shows five splines 212 positioned about a circumference of the cable. For example, as discussed above, one or more splines 212 may be helically wrapped about the twisted pairs. Alternatively, one or several splines may be longitudinally placed in the cable. These splines may be equally spaced about the inner circumference, may be randomly spaced, may all be located on one side or may be otherwise grouped and/or spaced apart within the cable. The example illustrated in FIG. 8 is intended only for the purpose of illustration and is not intended to be limiting. Furthermore, the splines (or rods) may include conductive and/or non-conductive materials such as, but not limited to, solid or foamed fluoropolymers, polyolefins, and other dielectric materials (with or without conductive additives or coatings). In some examples, the splines 212 may include flame retardant and/or smoke suppressive additives or materials with flame retardant and/or smoke suppressive characteristics.

As discussed above, a cable according to various embodiments of the invention may include a jacket, having a single layer or multiple layers, that may surround the transmission media and any other internal elements (e.g., a separator, binder or shield) making up the cable. In one embodiment, a cable may have a striated or "fluted" jacket that includes one or more protrusions that extend either inwardly toward a center of the cable from an internal circumference of the jacket or outwardly from an exterior circumference of the jacket. These protrusions may increase the distance between the twisted pairs of one cable and the twisted pairs of another adjacent cable and, in the case of inwardly extending protrusions may increase the distance between the twisted pairs and the cable jacket. As a result, such a jacket may provide numerous advantages such as, for example, reducing alien crosstalk (compared to cables with conventional round, smooth jackets) and/or providing a cable having a lower value of signal attenuation (also compared to a conventional cable with a round, smooth jacket) due to the decreased absorption of the signal by the dielectric cable jacket.

Figure 9:
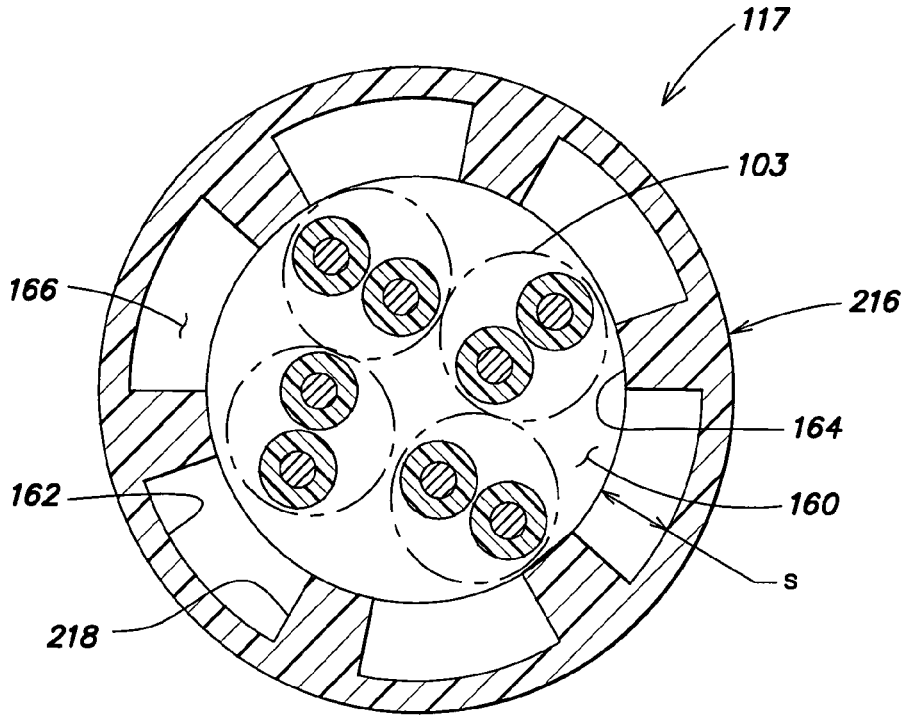
FIG. 9 is a cross-sectional diagram of one example of a cable including a jacket having internal striations according to another embodiment of the invention.

Referring to FIG. 9, there is illustrated one example of a cable having a striated jacket according to one embodiment of the invention. The cable 117 may include an inner region 160 that may include a plurality of transmission media (e.g., twisted pairs 103) and, optionally, a separator (not shown) disposed among the plurality of transmission media. In this embodiment, the cable jacket may be formed having one or more inwardly extending protrusions 218 that extend toward the plurality of transmission media. Such a jacket construction may be advantageous in that the protrusions may result in there being relatively more air separating the jacket 216 from the twisted pairs 103 compared with a conventional jacket. Although the cable 117 in FIG. 9 (and other Figures) is illustrated with four twisted pairs of insulated conductors 103, it is to be appreciated that the invention is not so limited and the cable may include more or fewer twisted pairs, or may employ transmission media other than twisted pairs (e.g., individual insulated conductors). The inwardly extending protrusions 218 may extend from an inner border (or circumferential surface) 162 of the jacket. In one embodiment, the jacket 216 may include a plurality of inwardly extending protrusions 218 that are spaced apart around the inner border 162 of the jacket 216. The inwardly extending protrusions 218 have inner ends 164 that may define the inner region 160.

According to one embodiment, the inwardly extending protrusions 218 may be formed such that the twisted pairs 103 may be contained within the inner region 160 and are spaced apart from the inner border of the cable jacket 216 by a distance "s," as shown in FIG. 9. In one example, s may be on the order of about 0.04 inches which may provide a good tradeoff between size of the cable and electrical performance. However, it is to be appreciated that many other values of s are also possible. With this arrangement, the twisted pairs may be spaced apart from the jacket and therefore, the effects of the cable jacket on the signal propagating through the twisted pairs (e.g., signal attenuation that may be caused by the proximity of the dielectric jacket to the twisted pairs) may be reduced. The protrusions 218 may be viewed as defining one or more spaces or cavities 166 that may exist between the inner circumferential surface 162 of the jacket and the inner region 160 of the cable. In some embodiments, this space 166 may be filled with air. However, it is to be appreciated that other fluids or dielectric materials may be used to fill the space. Since air has a dielectric constant substantially lower than the dielectric constant of most insulating materials used to form the jacket 216, creation of the space 166 by the protrusions 218 may result in the jacket material having a relatively lesser effect (compared with a conventional jacket) on the performance characteristics of the twisted pairs 103. For example, there may be less attenuation of the electromagnetic signals propagating through the twisted pairs due to the increases amount of air surrounding the twisted pairs and the increased distance between the twisted pairs and the bulk of the cable jacket material. In addition, because the jacket 216 may be held further away from the twisted pairs 103 by the protrusions 218, the protrusions may help to reduce alien crosstalk between adjacent or closely spaced cables, for example, in a bundled cable or a conduit in a building.

Figure 10:
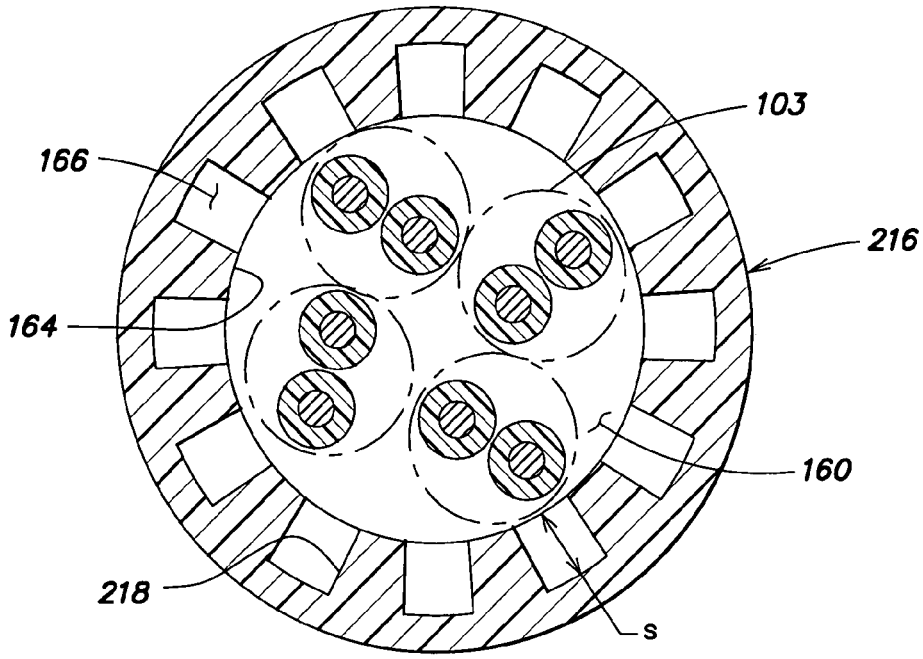
FIG. 10 is a cross-sectional diagram of another example of a cable including a jacket with internal striations according to another embodiment of the invention.
Figure 11:
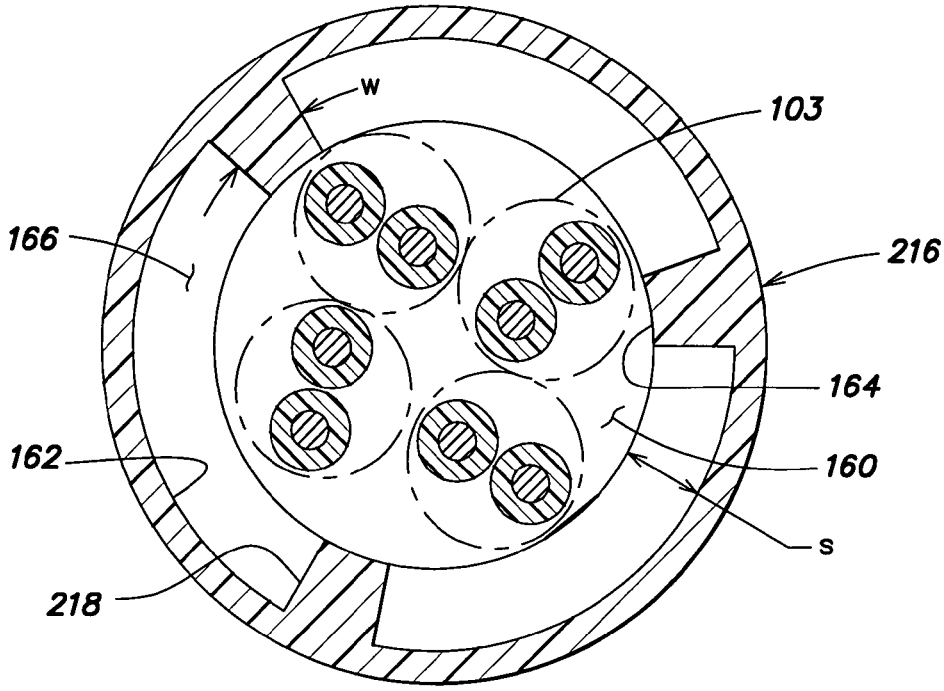
FIG. 11 is a cross-sectional diagram of another example of a cable including a jacket with internal striations according to another embodiment of the invention.

As illustrated in FIGS. 9-11, various embodiments of the cable jacket 216 may include various numbers of inwardly extending protrusions 218. As will be appreciated by those skilled in the art, there may be a tradeoff between the number of inwardly extending protrusions, which may limit movement of the twisted pairs within the cable, and the amount of dielectric loss due to proximity of the dielectric jacket material to the twisted pairs. As can be seen in FIG. 11, the fewer inwardly extending protrusions that may be provided, the greater the likelihood that one or more twisted pairs may not be confined within the inner region 160. However, it is also to be appreciated that the width, w, of the inwardly extending protrusions may be increased to provide the same or similar confinement of the twisted pairs as would be the case with a larger number of thinner inwardly extending protrusions. In addition, jackets may be formed with a plurality of inwardly extending protrusions having different shapes and/or sizes. For example, some protrusions may be formed with a width, w, or extension, s, from the inner border of the jacket that is different than the width, w, and/or extension (or height), s, of other protrusions in the cable. In one example, provision of a plurality of protrusions having varying extensions (or heights), s, may impart a varying center to the cable. In one embodiment, the protrusions and the jacket may be formed such that the space (or air gap) 166 has a substantially arc shape, as shown, for example, in FIG. 11. For example, selecting a circular jacket with an inner diameter in a range of about 0.100 to 0.500 inches and the number of protrusions to be approximately eight, may result in the inner circumferential surface of the jacket, between any two protrusions, having an arc shape. Of course, it will be appreciated that an arc-shaped surface (and thus air gap) may also be obtained with a different number of protrusions and/or a different jacket diameter, and the invention is not limited to the specific examples given herein. In another example, the protrusions may have a substantially triangular shape with the base of the triangle being adjacent the inner border 162 of the jacket and the tip of the triangle extending inwardly toward the twisted pairs. In this example, if the protrusions are sufficiently closely spaced to one another, the jacket may have a "sawtooth" appearance provided by the protrusions. It is to be appreciated that many other shapes may be possible for the protrusions and that the invention is not limited to the specific examples and/or illustrations given herein. Furthermore, it will be appreciated that the protrusions may be spaced about the inner circumferential surface of the jacket in numerous ways. For example, the protrusions may be evenly spaced, randomly spaced, provided in groups (for example, such that the protrusions within a group may have a first spacing relative to one another and the groups of protrusions may have a second spacing relative to another group), etc., and the invention is not limited to any particular spacing of the protrusions.

According to one embodiment, the inwardly extending protrusions 218 may be helically formed along the inner circumferential surface of the jacket 216 such that the jacket is helically striated along the inner circumferential surface. In this embodiment, one or a few helically formed inwardly extending protrusions may provide a barrier along the longitudinal length of the cable that may maintain the twisted pairs 103 within the inner region 160 that is defined by the end(s) 164 of the protrusions(s) 220. It will be appreciated that a shorter "twist lay" of such helical striations may provide more containment of the twisted pairs at the expense of using more dielectric material to form the projection(s), whereas a longer "twist lay" of the striations may reduce the amount of material used, but may allow one or more twisted pairs to occasionally or periodically contact the inner border 162 of the jacket.

According to another embodiment, the cable jacket may be twisted (referred to as "cabled") with the twisted pairs (and optional other elements such as a separator, shield or binder) with a given cable lay. In this embodiment, even if the one or more inwardly extending protrusions are formed longitudinally along the length of the cable as straight or substantially straight ridges, the cabling procedure will result in the protrusions forming helical ridges along the inside of the cable jacket with a twist lay equal to the cable lay. Thus, as discussed above in reference to helically formed projection(s), the helical ridges formed one or more protrusions may provide a barrier along the longitudinal length of the cable that may contain the twisted pairs within the inner region. Again, depending on the cable lay, it may be possible for one or more twisted pairs to "dip" between the helical ridges and contact the inner circumferential surface of the jacket. Thus, it will be recognized by those skilled in the art that there may be a tradeoff between a tight (or short) cable lay that allow the projection(s) to better contain the twisted pairs within the inner region and the effects of a shorter cable lay on the performance and material and manufacturing costs of the cable.

As discussed above, provision of a rod or spacer, such as a helixed spline described above, wrapped around the transmission media (and separator if present) may achieve the same or a similar result as providing a jacket with internal striations. In either case, the bulk of the jacket may be held away from the cable transmission media, which may be kept more toward a center of the cable. These constructions may therefore serve to reduce alien crosstalk and/or to reduce the effect of the jacket on the data transmission properties and performance of the cable. It is to be appreciated that cables having either or both of an internally striated jacket and a spacer (which may be a helixed spline or a solid or foamed dielectric spacer having a non-helixed construction) are considered part of the invention, as well as the many variations in structure (e.g., size, shape, materials etc.) of the jacket and/or spacer that may be apparent to those skilled in the art.

The cable jacket may include any insulating material that is used in the industry and can be shaped to form the jacket, for example, by extrusion. In one embodiment, the jacket 117 may be constructed of a low dielectric constant thermoplastic material. In some other examples, the jacket may be made from a solid low dielectric constant fluoropolymer or fluorocopolymer such as, for example, ethylene chlortrifluoroethylene (E-CTFE), FEP or FEP family materials, MFA, low smoke PVC, flame retardant polyolefin or other similar materials.

Figure 12:
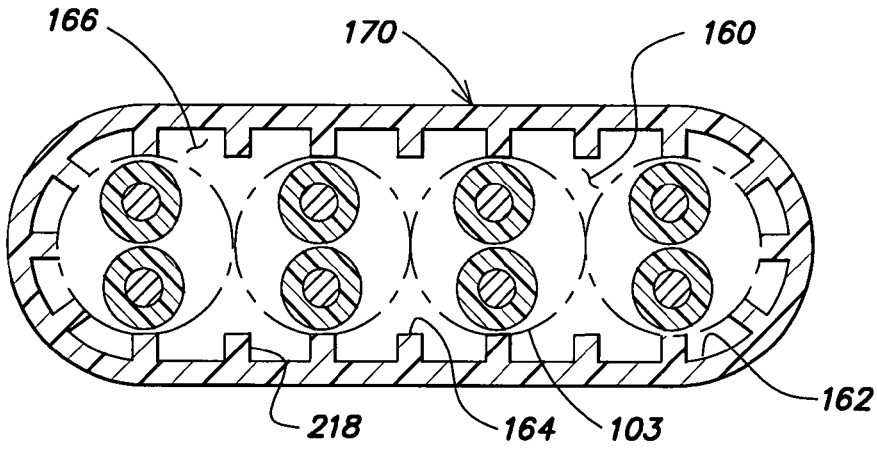
FIG. 12 is a an illustration of another embodiment of a cable including an internally striated jacket according to the invention.

According to some embodiments, the cable jacket may have any shape that can be extruded. For example, referring to FIG. 12, in one embodiment, a cable jacket 170 may have a roughly oval shape with a plurality of inwardly extending protrusions 218. As discussed above, this oval-shaped jacket may have more or fewer inwardly extending protrusions than the number shown in FIG. 12. In addition, the protrusions may have various shapes and sizes, as discussed above. Again, the inwardly extending protrusions 218 may create one or more spaces or air gaps 166 between the twisted pairs and an inner border 162 of the cable jacket, thereby reducing the effects of the dielectric jacket on signals propagating in the twisted pairs and also reducing alien crosstalk.

Figure 13:
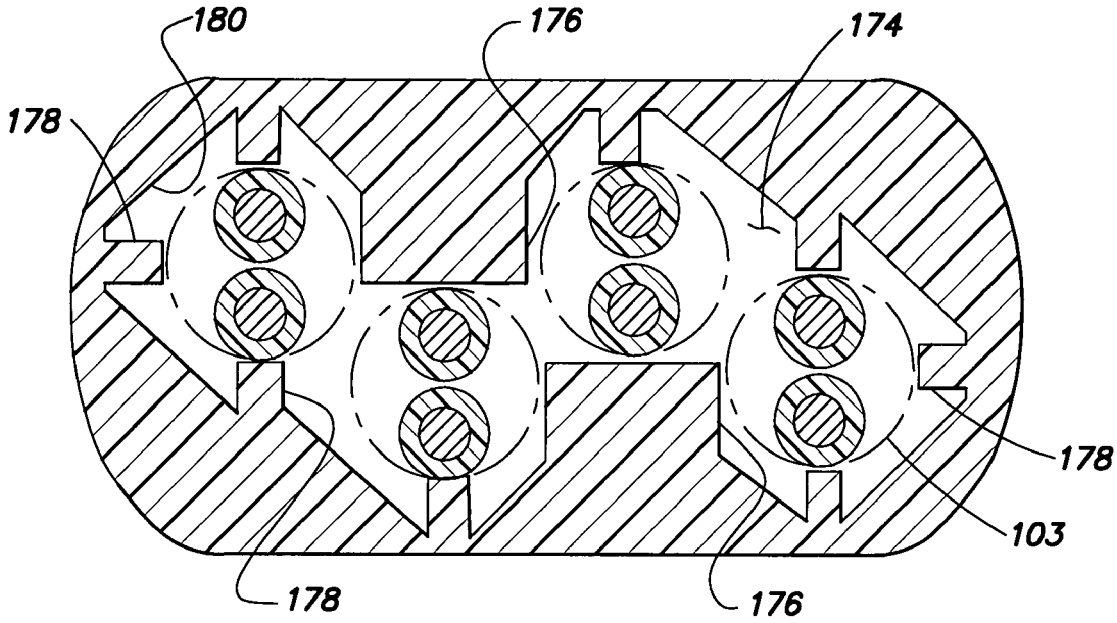
FIG. 13 is a diagram of another example of a cable including an internally striated jacket according to an embodiment of the invention.

In another example, a jacket may include a plurality of inwardly extending protrusions that are shaped and arranged to maintain transmission media in a predetermined arrangement. Referring to FIG. 13, there is illustrated one example of a cable having a jacket 172 that is roughly oval shaped having inwardly extending protrusions forming individual cable channels or regions 174. In the illustrated example, the protrusions 176 may be formed such that channels 174 are offset from one another in the vertical direction. In other words, the twisted pairs disposed in adjacent channels may be axially offset from one another. This configuration may facilitate reduction of crosstalk between the twisted pairs by increasing the center-to-center distance between adjacent twisted pairs. Additional inwardly extending protrusions 178 may be provided to maintain the twisted pairs securely within the individual channels 174 and/or to maintain an air gap between the twisted pair and the inner border 180 of the cable jacket, as discussed above. Furthermore, referring again to FIG. 13, because the twisted pairs of conductors are spaced apart from the cable jacket, if another similar cable is placed on top of the cable, there may be increased distance between corresponding twisted pairs of the two data cables. This increased distance may reduce alien crosstalk, as discussed above. Thus, the construction of FIG. 13, or a similar construction, may both facilitate reducing crosstalk between the twisted pairs in the cable while also reducing alien crosstalk and the adverse effects (such as dielectric loss and signal attenuation) caused by proximity of the cable jacket material to the twisted pairs, as discussed above.

Figure 14:
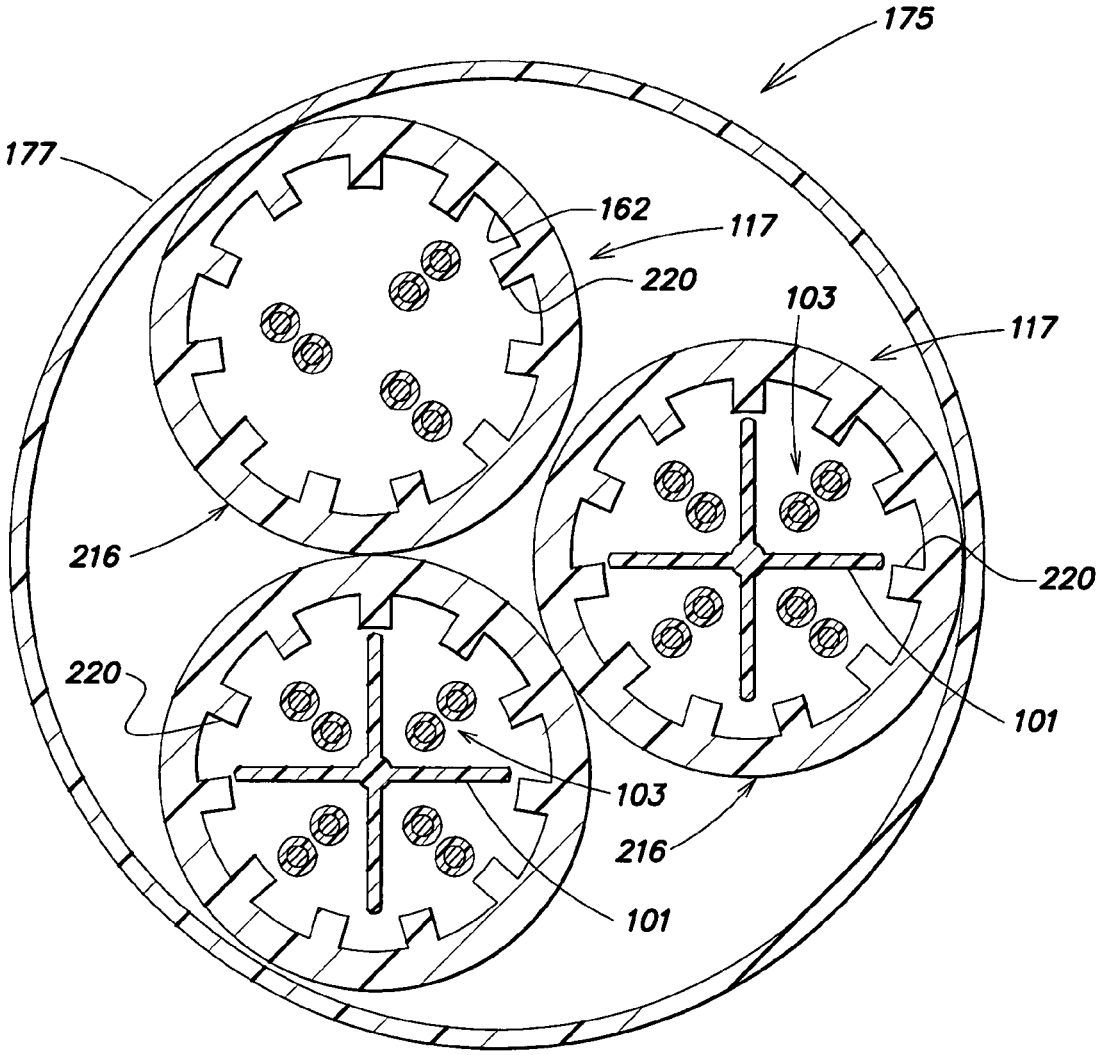
FIG. 14 is an illustration of an embodiment of a bundled cable including a plurality of cables having interlocking externally striated jackets, according to the invention.

According to another embodiment, several cables such as those described above may be bundled together to provide a bundled cable. Within the bundled cable may be provided numerous embodiments of the cables described above. For example, the bundled cable may include some shielded and some unshielded cables, some four-pair cables and some having a different number of pairs. In addition, the cables making up the bundled cable may include conductive or non-conductive cores having various profiles, including the helixed spline discussed above. One example of a bundled cable 175 including a plurality of individual cables 117, each having a jacket 216 including one or more inwardly extending protrusions 220, is illustrated in FIG. 14. In one example, the multiple cables making up the bundled cable may be helically twisted together and/or wrapped in a binder 177. In one example, the bundled cable may include a rip-cord to break the binder 177 and release the individual cables from the bundle.

Figure 15:
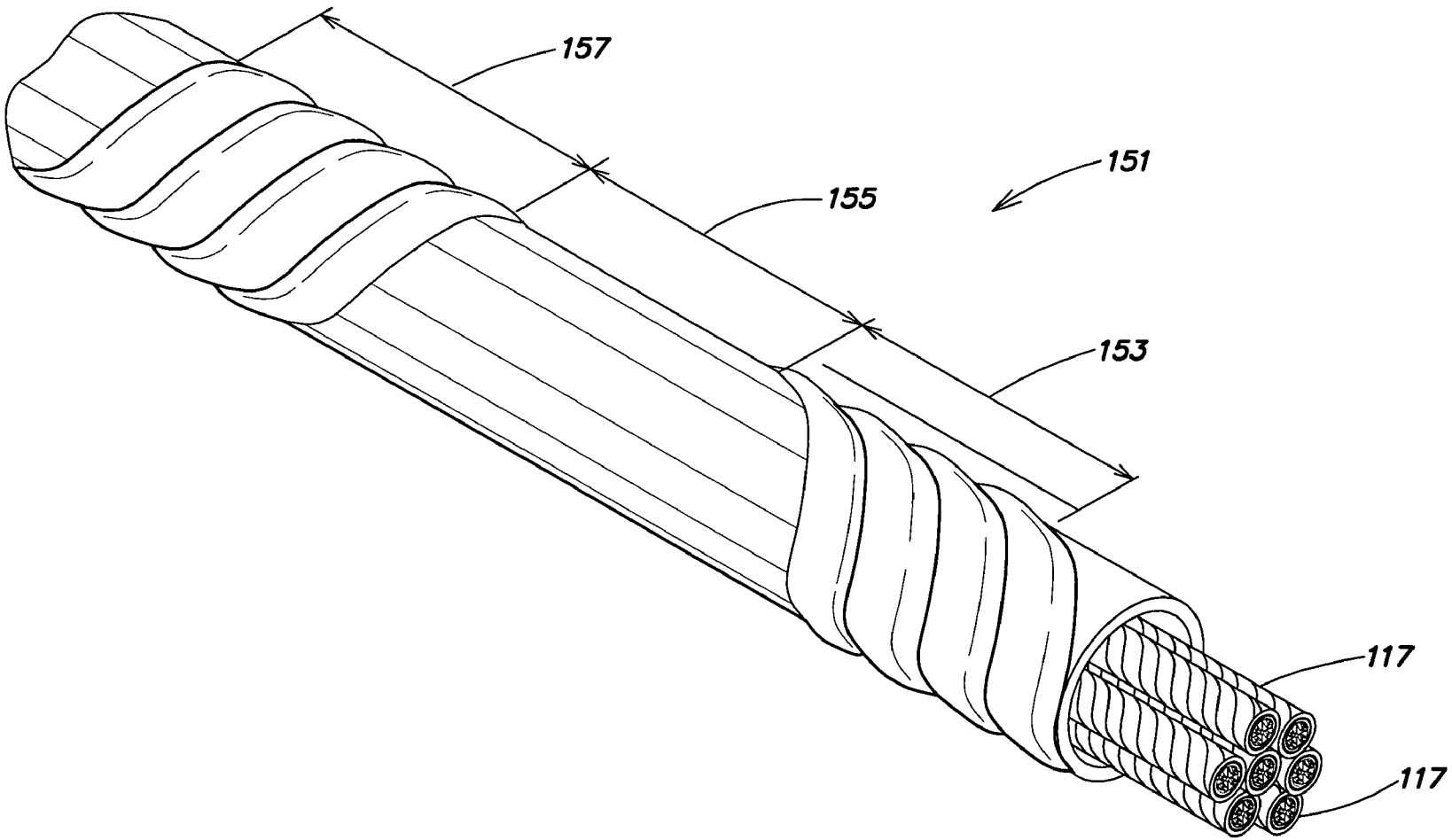
FIG. 15 is a perspective view of one embodiment of a bundled cable according to the invention, illustrating oscillating cabling.

Referring to FIG. 15, there is illustrated another embodiment of a bundled cable 151 which may be cabled in an oscillating manner along its length rather than cabled in one single direction along the length of the cable. In other words, the direction in which the cable is twisted (cabled) along its length may be changed periodically from, for example, a clockwise twist to an anti-clockwise twist, and vice versa. This is known in the art as S/Z type cabling and may require the use of a special twisting machine known as an oscillator cabler. As discussed above, a similar machine may be used to extrude a core (e.g., a helixed spline) with an S/Z configuration. In some examples of bundled cables 151, each individual cable 117 making up the bundled cable 151 may itself be helically twisted (cabled) with a particular cable lay length, for example, about 5 inches. The cable lay of each cable may tend to either loosen (if in the opposite direction) or tighten (if in the same direction) the twist lays of each of the twisted pairs making up the cable. If the bundled cable 151 is cabled in the same direction along its whole length, this overall cable lay may further tend to loosen or tighten the twist lays of each of the twisted pairs. Such altering of the twist lays of the twisted pairs may adversely affect the performance of at least some of the twisted pairs and/or the cables 117 making up the bundled cable 151. However, helically twisting the bundled cable may be advantageous in that it may allow the bundled cable to be more easily bent, for example, in storage or when being installed around corners. By periodically reversing the twist lay of the bundled cable, any effect of the bundled twist on the individual cables may be substantially canceled out. In one example, the twist lay of the bundled cable may be approximately 20 inches in either direction. As shown in FIG. 15, the bundled cable may be twisted for a certain number of twist lays in a first direction (region 153), then not twisted for a certain length (region 155), and then twisted in the opposite direction for a number of twist lays (region 157).

Figure 16:
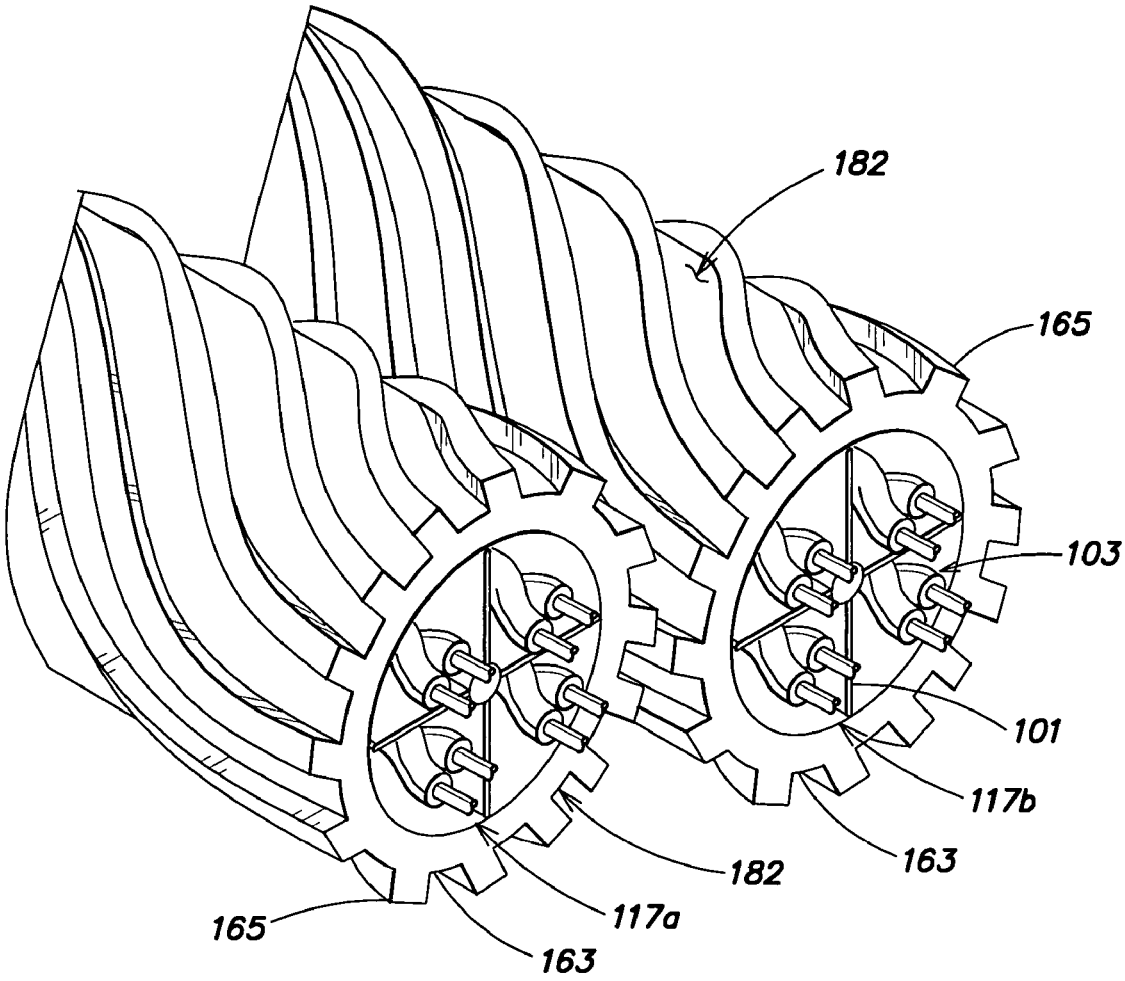
FIG. 16 is an illustration of an embodiment of cables having jackets with outwardly extending protrusions, according to the invention.

According to another embodiment, a cable may be provided with a jacket having one or more outwardly extending protrusions from an outer circumferential surface of the cable. Such a construction may facilitate reduction of alien crosstalk between twisted pairs of nearby cables, as discussed further below. Referring to FIG. 16, there is illustrated an example of cables having a jacket with an exterior striated surface. FIG. 16 illustrates two cables 117*a* and 117*b*, each cable having jacket 182 with a plurality of outwardly extending protrusions 165 spaced about an outer circumferential surface 163 of the jacket 182. It is to be appreciated that although FIG. 16 illustrates the cables each including four twisted pairs 103 and a separator 101, the invention is not so limited and either or both cables may include more or fewer twisted pairs (or other transmission media) and the separators 101 are optional. In one example, the cables 117*a*, 117*b* may be helically twisted with a cable lay. In this example, the protrusions 165 may form helical ridges along the length of the cables 117, as shown in FIG. 16. The protrusions 165 may thus serve to further separate one cable 117*a* from another 117*b*, and may thereby act to reduce alien crosstalk between the twisted pairs of cables 117*a*, 117*b*.

Figure 17:
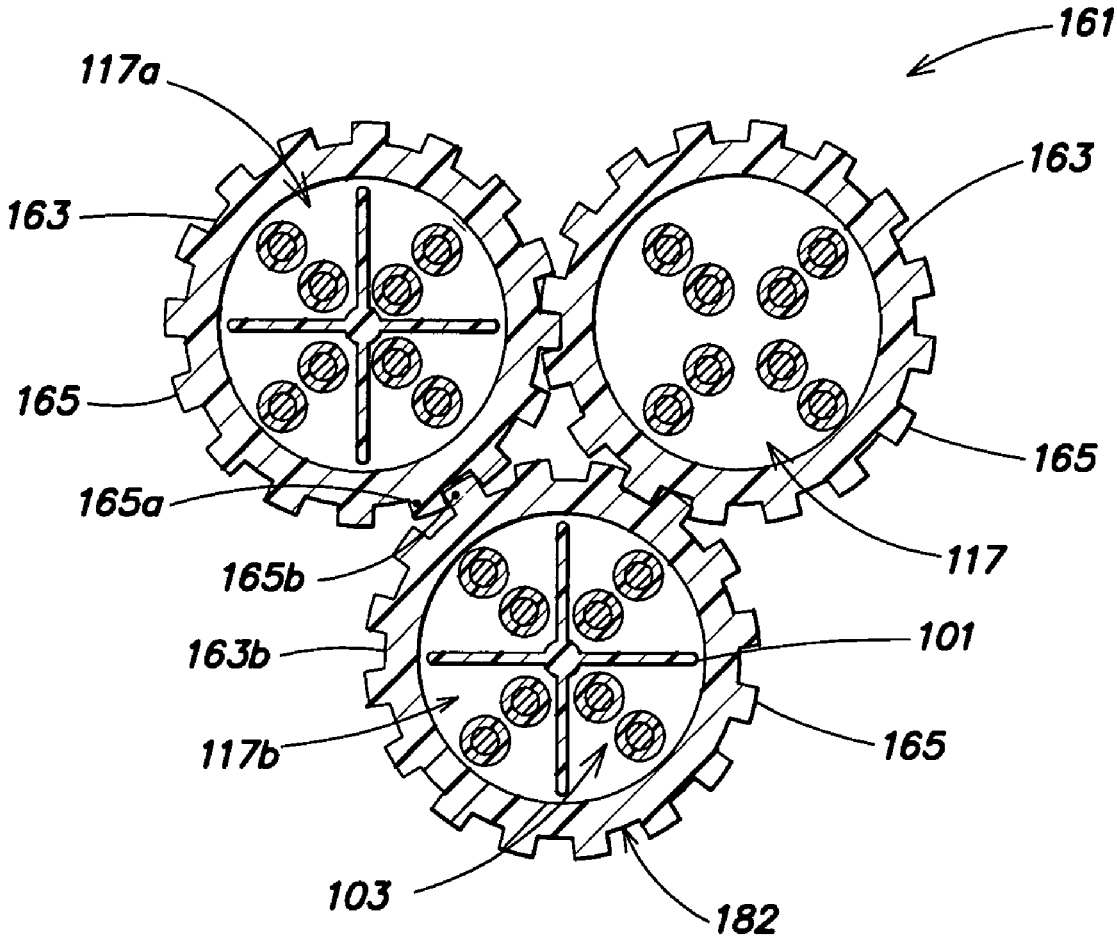
FIG. 17 is an illustration of another embodiment of a plurality of cables having interlocking striated jackets, according to the invention.

Referring to FIG. 17, there is illustrated a plurality of cables 117 having externally striated jackets as described above. In one example, the cables 117 may not be twisted with a cable lay. In this example, the protrusions 165 may be constructed such that the protrusions 165*a* of the jacket of one cable 117*a* may mate with the protrusions 165*b* of the jacket 182 of another cable 117*b* so as to interlock two corresponding cables 117*a*, 117*b* together, as illustrated in FIG. 17. This may be particularly useful if multiple cables are to be installed together, for example, in a building conduit, or if two or more cables are to be bundled together to provide a bundled cable. The individual cables 117 may "snap" together, possibly obviating the need for a binder to keep the bundled cable 161 together, or facilitating installation of multiple cables by holding the cables together. This embodiment may also be advantageous in that the cables 117 may be easily separated from one another when necessary.

It is to be appreciated that, as was the case with the jackets having inwardly extending protrusions discussed above, the outwardly extending protrusions 165 may have various shapes and sizes and the illustrated examples are not intended to be limiting. For example, in some embodiments, a jacket may have a plurality of outwardly extending protrusions from the outer circumferential surface 163 of the jacket that may be evenly, randomly or otherwise spaced about the outer circumferential surface of the jacket. Alternatively, a jacket may only one outwardly extending projection that may extend longitudinally along the length of the jacket. In one example, such a single outwardly extending projection may be helically formed about the jacket. Alternatively, the outwardly extending projection may initially be formed as a substantially straight stripe along the jacket, but cabling of the jacket may result in the projection forming a helical ridge along the outer circumferential surface of the jacket. In addition, the width and depth (or height) of the outwardly extending projection(s), as well as their shape, may be varied as was discussed above in reference to jackets comprising inwardly extending projection(s).

Figure 18:
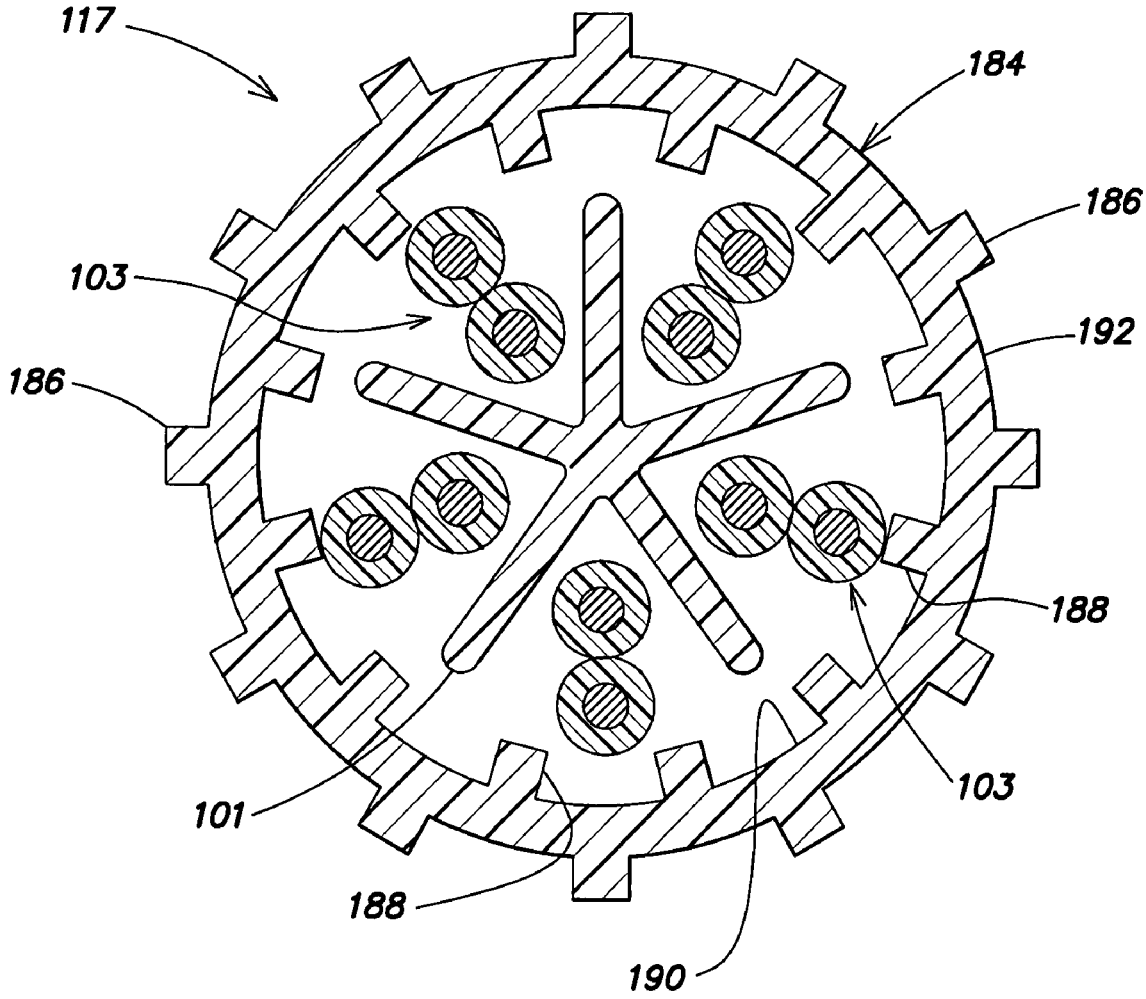
FIG. 18 is a diagram of one example of a cable including a jacket having both inwardly and outwardly extending protrusions according to another embodiment of the invention.
Figure 19:
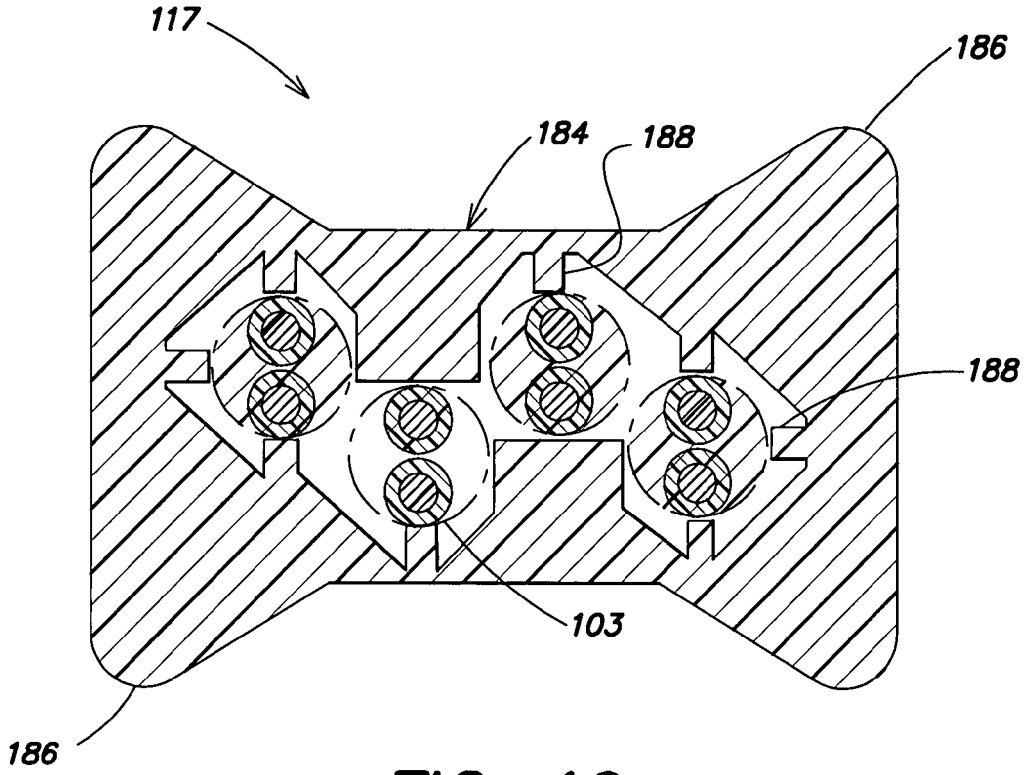
FIG. 19 is a diagram of another example of a cable including a jacket having both inwardly and outwardly extending protrusions according to the invention.
Figure 20:
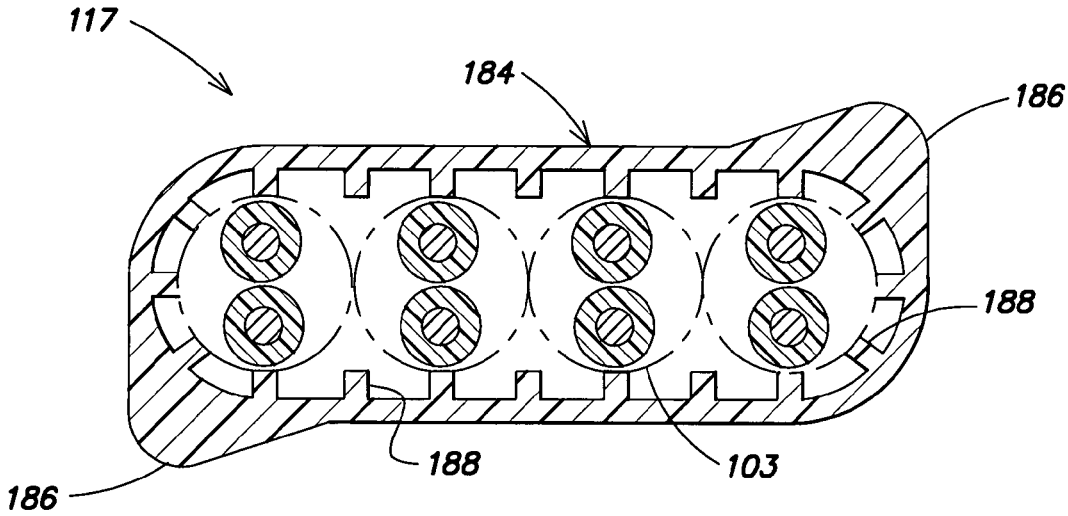
FIG. 20 is a diagram of another example of a cable including a jacket having both inwardly and outwardly extending protrusions according to the invention.

Referring to FIGS. 18-20, there are illustrated some examples of cable with jackets including both inwardly and outwardly extending protrusions. For example, FIG. 18 illustrates a cable 117 comprising a jacket 184 having a substantially circular form (defined by either an inner circumferential surface 190 or outer circumferential surface 192 and a plurality of inwardly extending protrusions 188 from the inner circumferential surface 190 and a plurality of outwardly extending protrusions 186 from the outer circumferential surface 192. FIGS. 19 and 20 illustrate two examples of cables 117 with substantially oval shaped jackets 184 that include a plurality of inwardly extending protrusions 188 and a plurality of outwardly extending protrusions 186. It is to be appreciated that the illustrated examples are intended for illustration only and are not intended to be limiting. As discussed above, the size, shape and placement of the inwardly extending protrusions and outwardly extending protrusions may be varied in any embodiment of a cable and the specific shapes, sizes and placements illustrated are not intended to apply only to the construction shown in a particular figure, nor to exclude other constructions that may be apparent to those skilled in the art.

Figure 21:
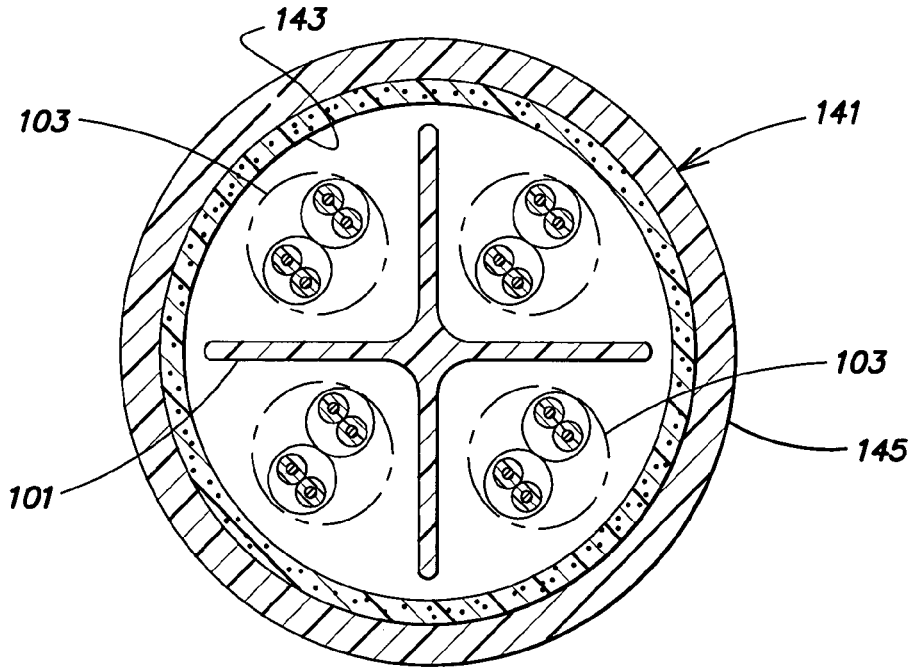
FIG. 21 is a cross-sectional diagram of a cable having a multi-layer jacket according to an embodiment of the invention.

According to another embodiment, a cable may comprise a multi-layer jacket. The various jacket layers may comprise the same or different materials and, in some examples, may include inwardly extending or outwardly extending protrusions. One example of a cable including a dual-layer jacket is illustrated in FIG. 21. In the illustrated example, the multi-layer jacket 141 includes an inner jacket layer 143 and an outer jacket layer 145. The first and second jacket layers of the multi-layer jacket 141 may be made of any suitable jacket material such as, for example, PVC, polyolefin, fluoropolymers (e.g., FEP or MFA), fire and/or smoke resistant materials, and the like. In one embodiment, the first and second jacket layers may be made of dissimilar insulation materials. More particularly, in one example, the inner jacket layer 143 may be made of a material having a lower dissipation factor and/or dielectric constant than the material of the outer jacket layer 145. In one example, the inner jacket layer may be a foamed polymer. This construction may be advantageous and may provide enhanced design flexibility because the inner jacket layer reduces the effect of the outer jacket layer on signal propagation in the transmission media of the cable. Thus, for example, the inner jacket layer which is closer to the transmission media may be selected based more on its electrical properties (such as dielectric constant and dissipation factor) whereas the outer jacket layer, which is kept away from the transmission media by the inner jacket layer, may be selected based on, for example, flame and/or smoke resistance, strength (for providing good protection to the cable), cost, etc., with little regard given to its electrical properties. For example, foaming reduces the effective dielectric constant of the material, but also weakens it making it less resistant to the forces experienced during, for example, spooling, handling and/or installation of the cable. With the dual-layer jacket of embodiments of the invention, the inner jacket layer may be foamed to improve electrical performance, while the strength of the cable can be maintained by providing a solid outer jacket layer.

Figure 22:
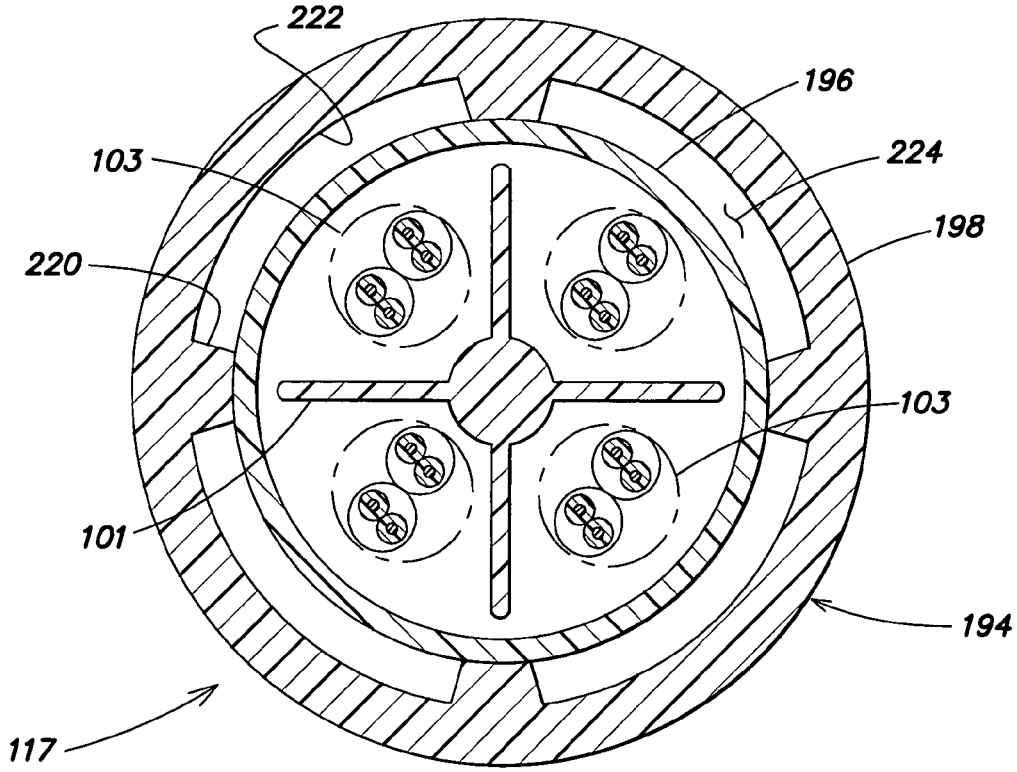
FIG. 22 is a cross-sectional diagram of another embodiment of a cable according to the invention.

Numerous embodiments of a cable having a multi-layer jacket construction are contemplated in addition to the example illustrated in FIG. 21. For example, referring to FIG. 22, there is illustrated one example of a cable 117 comprising a dual-layer jacket construction according to an embodiment of the invention. The cable comprises a plurality of twisted pairs of insulated conductors 103 and optionally a separator 101 that are surrounded by a dual-layer jacket 194. The dual-layer jacket 194 comprises an inner jacket layer 196 and an outer jacket layer 198. It is to be appreciated that in one example, the inner jacket layer 196 may be replaced by a binder. In one embodiment, the outer jacket layer 198 may comprises a plurality of inwardly extending protrusions 220 extending away from an inner circumferential surface 222 of the outer jacket layer 198. Ends of the plurality of inwardly extending protrusions 220 may contact, and in some examples may be bonded to, the inner jacket layer 196. As a result, the dual-layer jacket 194 may comprise a plurality of closed cells 224 formed between the inner jacket layer 196 and the inner circumferential surface 222 of the outer jacket layer 198. It will be appreciated that the same result may be achieved by replacing the inwardly extending protrusions 222 with outwardly extending protrusions formed on an outer circumferential surface of the inner jacket layer 196, the ends of which protrusions may contact the inner circumferential surface of the outer jacket layer 198. Furthermore, a similar result may also be achieved with a single layer jacket having closed cells or cavities formed therein. In addition, the jacket may be dual-layer with closed cells or cavities formed in one or both layers. These and similar alternatives are considered part of this disclosure.

In one example, the cavities may be filled with air and may therefore serve to lower the overall effective dielectric constant of the jacket. In addition, such air pockets may allow provision of a thicker overall jacket without requiring an increase in total jacket material used. This may be a cost effective way in which to improve alien crosstalk by increasing the spacing between transmission media of adjacent cables due to the thicker jackets. Furthermore, in embodiments where the air pockets exist between two jacket layers of dissimilar materials, the air pockets may further distance the bulk of the outer jacket layer from the transmission media. This may allow the second jacket layer material to be selected without concern regarding its effect on the transmission media, as discussed above.

Figure 23A:
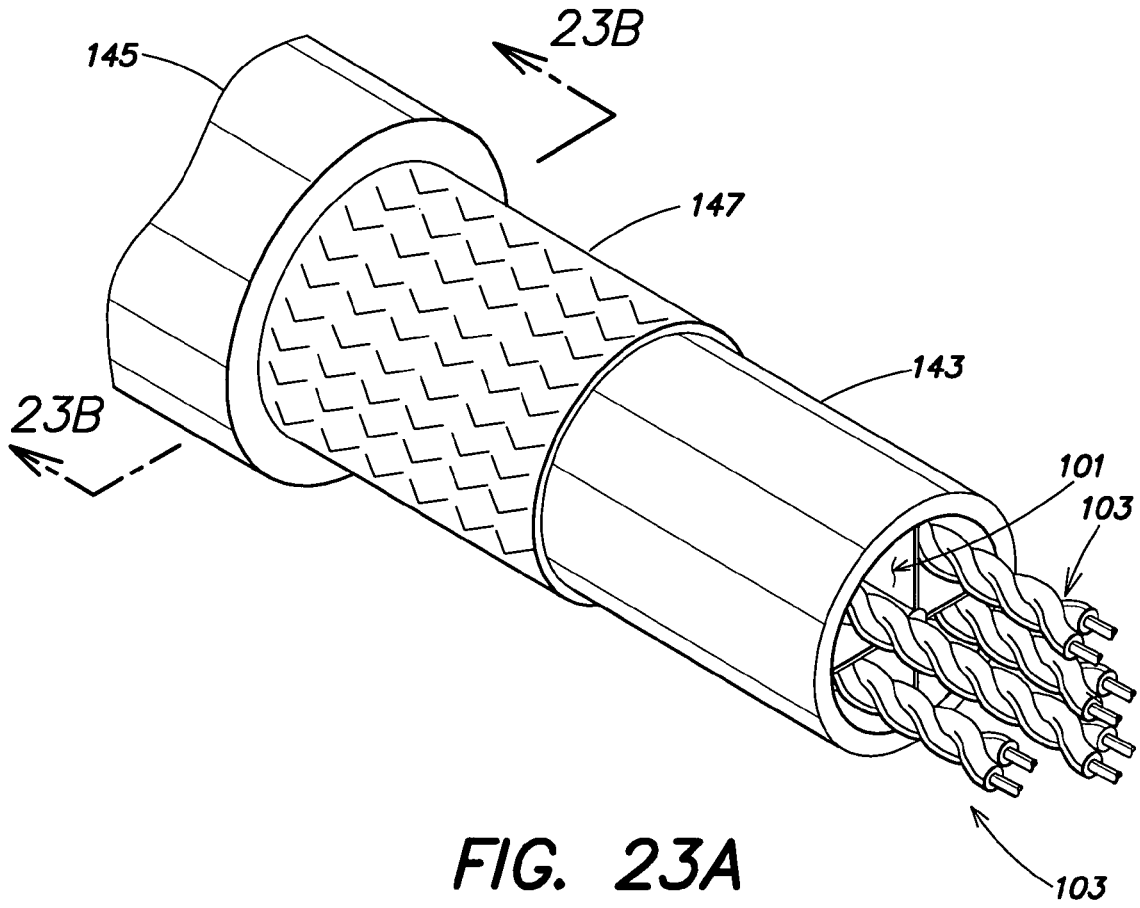
FIG. 23A is a perspective view of a cable having a dual-layer jacket according to another embodiment of the invention.
Figure 23B:
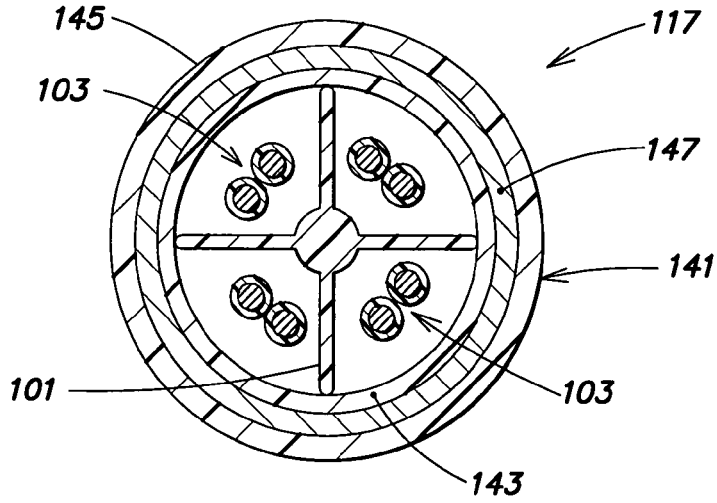
FIG. 23B is a cross-sectional view of the cable of FIG. 23A, taken along line 23B-23B in FIG. 23A.

According to another embodiment, a cable may comprise a dual-layer jacket with an element disposed between the first and second jacket layers. This element may be non-conductive or conductive (for example, a drain wire or a conductive shield that) and, optionally, may be wrapped around the inner jacket layer. Referring to FIGS. 23A and 23B, there is illustrated a cable 117 including a dual-layer jacket 141 comprising a first, inner layer 143 and a second, outer layer 145 with conductive shield 147 placed between the first and second jacket layers 143, 145. The shield 147 may act to prevent alien crosstalk between adjacent or nearby cables. The shield 147 may be, for example, a metal braid or foil that extends partially or substantially around the first jacket layer 143 along the length of the cable. An advantage to providing the shield over the inner jacket layer 143, rather than beneath the inner jacket layer, is that the shield 147 may be isolated from the twisted pairs 103 by the first jacket layer 143 and may thus have little impact on the twisted pairs. This may be advantageous in that little or no adjustment may need to be made to, for example conductor or insulation thicknesses of the twisted pairs 103. In the illustrated embodiment, because the shield is isolated from the twisted pairs 103 and the separator 101 by the first jacket layer 143, the separator 101 may be conductive or non-conductive.

Figure 24:
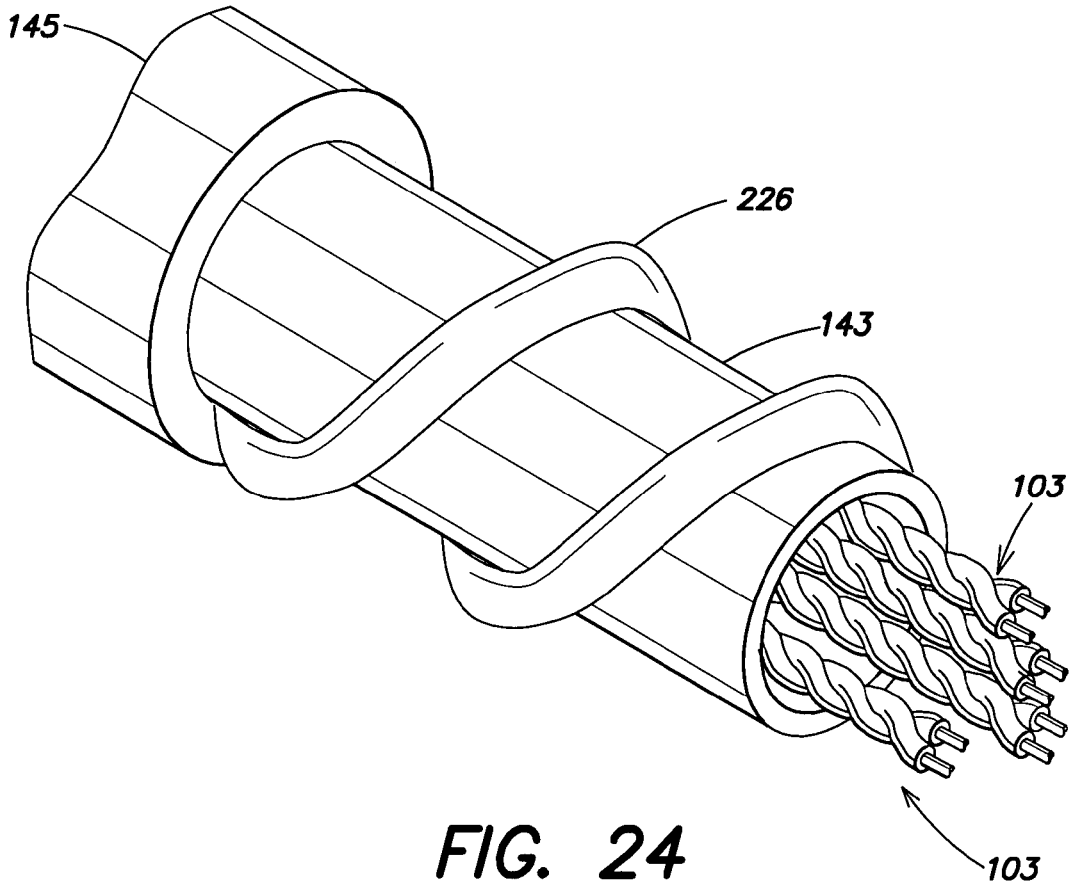
FIG. 24 is a perspective view of a cable including a dual-layer jacket and an element disposed between the two layers of the dual-layer jacket.
Figure 25:
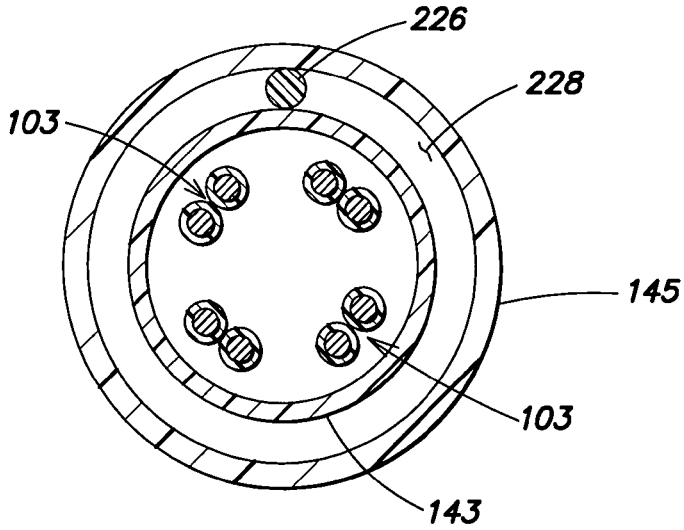
FIG. 25 is a cross-sectional view of the cable of FIG. 24 taken along line C-C.

In another embodiment, the element disposed between the first and second jacket layers of a dual-layer jacket may include a dielectric spacer. This spacer may be, for example, a dielectric rod or filler or a helixed spline such as described above. In one example, the dielectric spacer may be helically wrapped around the inner jacket layer, as illustrated in FIG. 24. Referring to FIG. 24, there is illustrated one example of a cable including a dual-layer jacket comprising an inner layer 143 and an outer layer 145 and a dielectric spacer 226 disposed between the two jacket layers and helically wrapped around the first jacket layer 143. In one embodiment, the dielectric spacer 226 may be sized such that an air gap 228 may be created between the first and second jacket layers, as illustrated in FIG. 25. Such a construction may be similar to the embodiment discussed above on reference to FIG. 22 in which either jacket layer may include a plurality of protrusions so as to form air gaps between the two jacket layers. It should also be appreciated that the inner jacket layer may be replaced with a binder. Furthermore, it is to be appreciated that although the examples illustrated herein include a dual-layer jacket, the invention is not so limited and the jacket may comprise more than two layers or, in the case where the inner jacket layer is replaced with a binder, a single jacket layer. In addition, features from the various examples may be combined and/or interchanged. For example, a cable may comprise both a conductive shield layer and a dielectric element disposed between the same or different jacket layers.

In one example, any of the jacket layers making up a multi-layer jacket may be bonded to one another using any suitable bonding technology known to those skilled in the art, including but not limited to, using a bonding agent (e.g., an adhesive applied to the surfaces of one or more jacket layers), heat-bonding, etc. In addition, in the embodiments in which an element is placed between the jacket layers, the element may be bonded to either layer it contacts. For example, referring to FIGS. 23A and 23B, the shield 147 may be bonded to either or both of the inner jacket layer 143 and/or outer jacket layer 145. Alternatively, where the shield is not present, the inner jacket layer may be bonded to the outer jacket layer. Of course, in other embodiments, the jacket layers may not be bonded to one another to allow easy separation of one layer from another.

Figure 26:
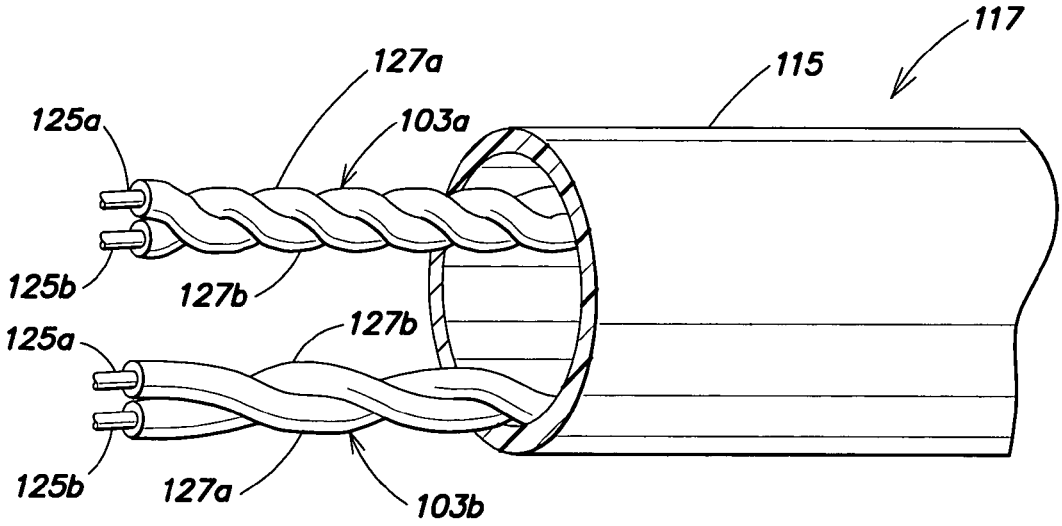
FIG. 26 is an illustration of one embodiment of a cable comprising twisted pairs having varying twist lays according to the invention.

As discussed above, a goal of cable designers may be to reduce crosstalk in the twisted pairs of a cable because crosstalk may adversely affect the quality and/or speed of data transmission through the twisted pairs. Various embodiments of cable jackets and other elements (e.g., shields or spacers) discussed herein may serve to reduce alien crosstalk. In addition, various embodiments of separators discussed herein may reduce crosstalk between pairs within a single cable. In some embodiments, particularly where the core 101 may be non-conductive, it may be advantageous to provide additional crosstalk isolation between the twisted pairs 103 by varying the twist lays of each twisted pair 103. For example, referring to FIG. 26, the cable 117 may include a first twisted pair 103*a* and a second twisted pair 103*b*. Each of the twisted pairs 103*a*, 103*b* includes two metal wires 125*a*, 125*b* each insulated by an insulating layer 127*a*, 127*b*. As shown in FIG. 26, the first twisted pair 103*a* may have a twist lay length that is shorter than the twist lay length of the second twisted pair 103*b*.

As discussed above, varying the twist lay lengths between the twisted pairs in the cable may help to reduce crosstalk between the twisted pairs. However, the shorter a pair's twist lay length, the longer the "untwisted length" of that pair and thus the greater the signal phase delay added to an electrical signal that propagates through the twisted pair. It is to be understood that the term "untwisted length" herein denotes the electrical length of the twisted pair of conductors when the twisted pair of conductors has no twist lay (i.e., when the twisted pair of conductors is untwisted). Therefore, using different twist lays among the twisted pairs within a cable may cause a variation in the phase delay added to the signals propagating through different ones of the conductors pairs. It is to be appreciated that for this specification the term "skew" is a difference in a phase delay added to the electrical signal for each of the plurality of twisted pairs of the cable. Skew may result from the twisted pairs in a cable having differing twist lays. As discussed above, the TIA/EIA has set specifications that dictate that cables, such as category 5 or category 6 cables, must meet certain skew requirements.

Figure 27:
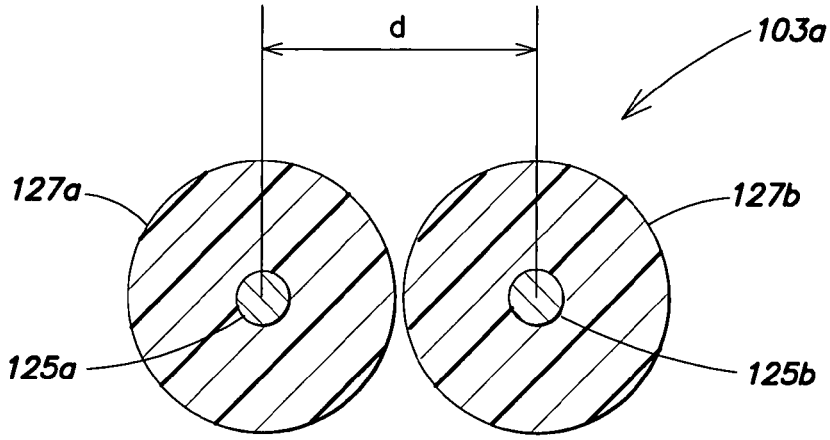
FIG. 27 is a cross-sectional view of a twisted pair of insulated conductors.

In addition, in order to impedance match a cable to a load (e.g., a network component), the impedance of a cable may be rated with a particular characteristic impedance. For example, many radio frequency (RF) components may have characteristic impedances of 50 or 100 Ohms. Therefore, many high frequency cables may similarly be rated with a characteristic impedance of 50 or 100 Ohms so as to facilitate connecting of different RF loads. The characteristic impedance of the cable may generally be determined based on a composite of the individual nominal impedances of each of the twisted pairs making up the cable. Referring to FIG. 27, the nominal impedance of a twisted pair 103*a* may be related to several parameters including the diameter of the wires 125*a*, 125*b* of the twisted pairs making up the cable, the center-to-center distance d between the conductors of the twisted pairs, which may in turn depend on the thickness of the insulating layers 127*a*, 127*b*, and the dielectric constant of the material used to insulate the conductors.

The nominal characteristic impedance of each pair may be determined by measuring the input impedance of the twisted pair over a range of frequencies, for example, the range of desired operating frequencies for the cable. A curve fit of each of the measured input impedances, for example, up to 801 measured points, across the operating frequency range of the cable may then be used to determine a "fitted" characteristic impedance of each twisted pair making up the cable, and thus of the cable as a whole. The TIA/EIA specification for characteristic impedance is given in terms of this fitted characteristic impedance. For example, the specification for a category 5 or 6 100 Ohm cable is 100 Ohms, +−15 Ohms for frequencies between 100 and 350 MHz and 100 Ohms +−12 Ohms for frequencies below 100 MHz.

In conventional manufacturing, it is generally considered more beneficial to design and manufacture twisted pairs to achieve as close to the specified characteristic impedance of the cable as possible, generally within plus or minus 2 Ohms. The primary reason for this is to take into account impedance variations that may occur during manufacture of the twisted pairs and the cable. The further away from the specified characteristic impedance a particular twisted pair is, the more likely a momentary deviation from the specified characteristic impedance at any particular frequency due to impedance roughness will exceed limits for both input impedance and return loss of the cable.

As the dielectric constant of an insulation material covering the conductors of a twisted pair decreases, the velocity of propagation of a signal traveling through the twisted pair of conductors increases and the phase delay added to the signal as it travels through the twisted pair decreases. In other words, the velocity of propagation of the signal through the twisted pair of conductors is inversely proportional to the dielectric constant of the insulation material and the added phase delay is proportional to the dielectric constant of the insulation material. For example, for a so-called "faster" insulation, such as fluoroethylenepropylene (FEP), the propagation velocity of a signal through a twisted pair 103 may be approximately 0.69c (where c is the speed of light in a vacuum). For a "slower" insulation, such as polyethylene, the propagation velocity of a signal through the twisted pair 103 may be approximately 0.66c.

The effective dielectric constant of the insulation material may also depend, at least in part, on the thickness of the insulating layer. This is because the effective dielectric constant may be a composite of the dielectric constant of the insulating material itself in combination with the surrounding air. Therefore, the propagation velocity of a signal through a twisted pair may also depend on the thickness of the insulation of that twisted pair. However, as discussed above, the characteristic impedance of a twisted pair also depends on the insulation thickness.

Applicant has recognized that by optimizing the insulation diameters relative to the twist lays of each twisted pair in the cable, the skew can be substantially reduced. Although varying the insulation diameters may cause variation in the characteristic impedance values of the twisted pairs, under improved manufacturing processes, impedance roughness over frequency (i.e., variation of the impedance of any one twisted pair over the operating frequency range) can be controlled to be reduced, thus allowing for a design optimized for skew while still meeting the specification for impedance.

According to one embodiment of the invention, a cable may comprise a plurality of twisted pairs of insulated conductors, wherein twisted pairs with longer pair lays have a relatively higher characteristic impedance and larger insulation diameter, while twisted pairs with shorter pair lays have relatively lower characteristic impedance and smaller insulation diameter. In this manner, pair lays and insulation thickness may be controlled so as to reduce the overall skew of the cable. One example of such a cable, using polyethylene insulation is given in Table 1 below.

TABLE 1

| Twisted Pair | Twist Lay Length (inches) | Diameter of Insulation (inches) |
|---|---|---|
| 1 | 0.504 | 0.042 |
| 2 | 0.744 | 0.040 |
| 3 | 0.543 | 0.041 |
| 4 | 0.898 | 0.040 |

Figure 28:
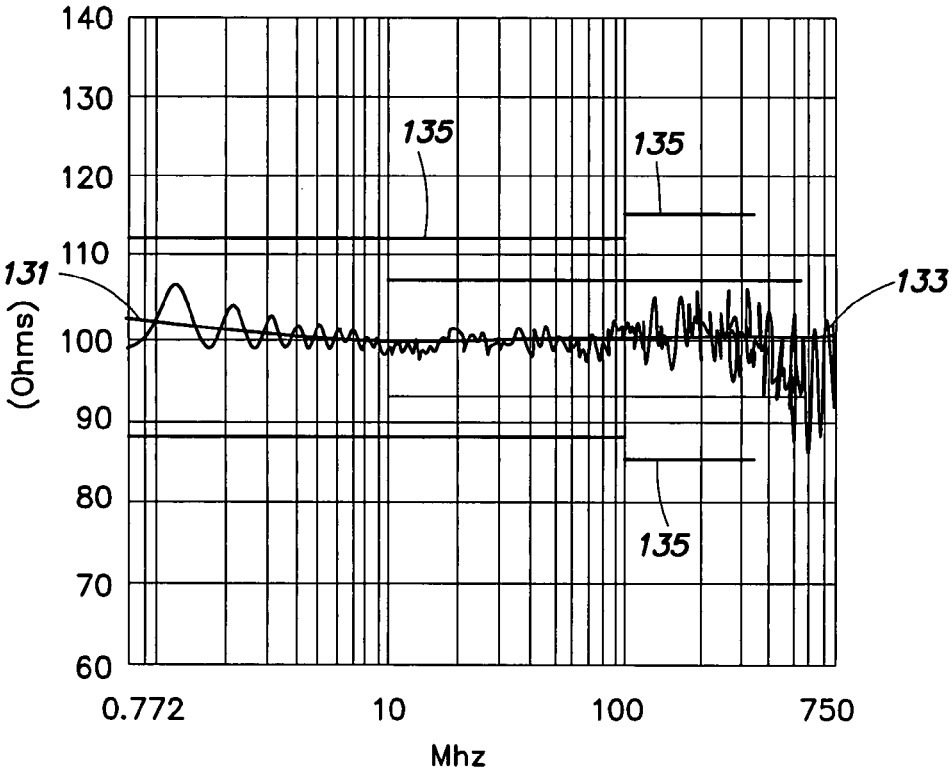
FIG. 28 is a graph of impedance versus frequency for a twisted pair of conductors according to the invention.
Figure 29:
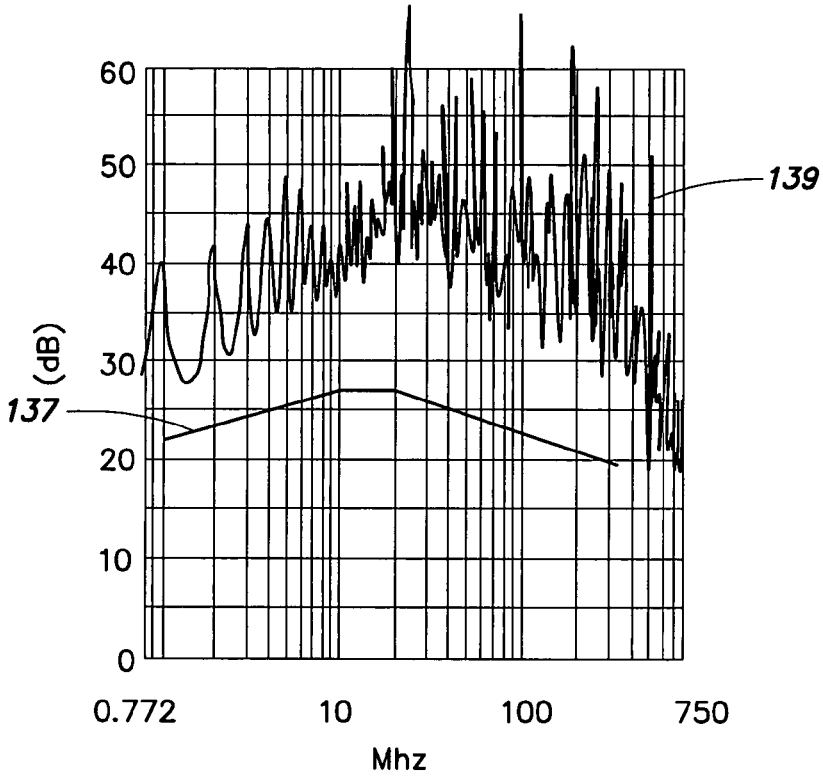
FIG. 29 is a graph of return loss versus frequency for the twisted pair of FIG. 28.

This concept may be better understood with reference to FIGS. 28 and 29 which respectively illustrate graphs of measured input impedance versus frequency and return loss versus frequency for twisted pair 1, for example, twisted pair 103*a*, in the cable 117. Referring to FIG. 28, the "fitted" characteristic impedance 131 for the twisted pair (over the operating frequency range) may be determined from the measured input impedance 133 over the operating frequency range. Lines 135 indicate the category 5/6 specification range for the input impedance of the twisted pair. As shown in FIG. 28, the measured input impedance 133 falls within the specified range over the operating frequency range of the cable 117. Referring to FIG. 29, there is illustrated a corresponding return loss versus frequency plot for the twisted pair 103*a*. The line 137 indicates the category 5/6 specification for return loss over the operating frequency range. As shown in FIG. 29, the measured return loss 139 is above the specified limit (and thus within specification) over the operating frequency range of the cable. Thus, the characteristic impedance could be allowed to deviate further from the desired 100 Ohms, if necessary, to reduce skew. Similarly, the twist lays and insulation thicknesses of the other twisted pairs may be further varied to reduce the skew of the cable while still meeting the impedance specification.

According to another embodiment, a four-pair cable was designed, using slower insulation material (e.g., polyethylene) and using the same pair lays as shown in Table 1, where all insulation diameters were set to 0.041 inches. This cable exhibited a skew reduction of about 8 ns/100 meters (relative to the conventional cable described above—this cable was measured to have a worst case skew of approximately 21 ns whereas the conventional, impedance-optimized cable exhibits a skew of approximately 30 ns or higher), yet the individual pair impedances were within 0 to 2.5 ohms of deviation from nominal, leaving plenty of room for further impedance deviation, and therefore skew reduction.

Allowing some deviation in the twisted pair characteristic impedances relative to the nominal impedance value allows for a greater range of insulation diameters. Smaller diameters for a given pair lay results in a lower pair angle and shorter non-twisted pair length. Conversely, larger pair diameters result in a higher pair angles and longer non-twisted pair length. Where a tighter pair lay would normally require an insulation diameter of 0.043" for 100 ohms, a diameter of 0.041" would yield a reduced impedance of about 98 ohms. Longer pair lays using the same insulation material would require a lower insulation diameter of about 0.039" for 100 ohms, and a diameter of 0.041" would yield about 103 ohms. As shown in FIGS. 28 and 29, allowing this "target" impedance variation from 100 Ohms may not prevent the twisted pairs, and the cable, from meeting the input impedance specification, but may allow improved skew in the cable.

Having thus described several aspects of at least one embodiment of this invention, it is to be appreciated various alterations, modifications, and improvements will readily occur to those skilled in the art. For example, any of the cables described herein may include any number of twisted pairs and any of the jackets, insulations and separators shown herein may comprise any suitable materials. In addition, the separators may be any shape, such as, but not limited to, a cross- or star-shape, or a flat tape etc., and may be positioned within the cable so as to separate one or more of the twisted pairs from one another. Any of the various separator embodiments described herein may be used with any of the jacket constructions described herein. In addition, features or aspects of any jacket embodiments described herein may be applied to any other jacket and/or separator embodiments. Such and other alterations, modifications, and improvements are intended to be part of this disclosure and are intended to be within the scope of the invention. Accordingly, the foregoing description and drawings are by way of example only and the scope of the invention should be determined from proper construction of the appended claims, and their equivalents.

What is claimed is:

1. A cable for data transmission, the cable comprising:

a plurality of twisted pairs of insulated conductors including a first twisted pair and a second twisted pair, each twisted pair comprising two insulated conductors twisted together in a helical manner;

a binder substantially surrounding the plurality of twisted pairs of insulated conductors;

a jacket surrounding the plurality of twisted pairs of insulated conductors and the binder; and a dielectric helixed spline disposed between the binder and the jacket along a length of the cable, the dielectric helixed spline providing an air gap between the jacket and the binder;

wherein the dielectric helixed spline comprises a fluoropolymer.

2. A cable for data transmission, the cable comprising:

a plurality of twisted pairs of insulated conductors including a first twisted pair and a second twisted pair, each twisted pair comprising two insulated conductors twisted together in a helical manner;

a binder substantially surrounding the plurality of twisted pairs of insulated conductors;

a jacket surrounding the plurality of twisted pairs of insulated conductors and the binder; and a dielectric helixed spline disposed between the binder and the jacket along a length of the cable, the dielectric helixed spline being separate from both the jacket and the binder and providing an air gap between the jacket and the binder;

wherein the dielectric helixed spline comprises a dielectric finned element twisted about its own axis to form the dielectric helixed spline.

3. The cable as claimed in claim 2, wherein the dielectric helixed spline is helically wound around the binder along the length of the cable.

4. A cable for data transmission, the cable comprising:

a plurality of twisted pairs of insulated conductors including a first twisted pair and a second twisted pair, each twisted pair comprising two insulated conductors twisted together in a helical manner;

a binder substantially surrounding the plurality of twisted pairs of insulated conductors;

a jacket surrounding the plurality of twisted pairs of insulated conductors and the binder; and an element disposed between the binder and the jacket along a length of the cable, the element being separate from both the jacket and the binder and providing an air gap between the jacket and the binder;

wherein, for any transverse cross-section taken along a radius of the cable, the element contacts the cable jacket at only one location on an inner circumference of the jacket.

5. The cable as claimed in claim 4, wherein the element comprises a dielectric helixed spline.

6. The cable as claimed in claim 5, wherein the dielectric helixed spline comprises a fluoropolymer.

7. The cable as claimed in claim 4, wherein the element comprises a plurality of separate dielectric helixed splines positioned about a circumference of the binder.

8. The cable as claimed in claim 4, further comprising a separator disposed among the plurality of twisted pairs of insulated conductors so as to separate at least one the plurality of twisted pairs from others of the plurality of twisted pairs.

9. The cable as claimed in claim 4, wherein the element is helically wrapped around the binder along the length of the cable.

10. The cable as claimed in claim 4, wherein the element is a conductive rod.

11. A cable for data transmission, the cable comprising:

a plurality of twisted pairs of insulated conductors including a first twisted pair and a second twisted pair, each twisted pair comprising two insulated conductors helically twisted together;

a separator disposed among the plurality of twisted pairs of insulated conductors so as to separate at least one the plurality of twisted pairs from others of the plurality of twisted pairs; and a jacket surrounding the plurality of twisted pairs and the separator, the jacket comprising a dual-layer structure including a first jacket layer and a second jacket layer;

wherein the jacket comprises a plurality of inwardly-projecting protrusions that extend away from an inner circumferential surface of at least one of the first jacket layer and the second jacket layer toward the plurality of twisted pairs of insulated conductors; and wherein the plurality of inwardly-projecting protrusions are substantially similarly sized.

12. The cable as claimed in claim 11, wherein the plurality of protrusions extend away from the inner circumferential surface of the first jacket layer.

13. The cable as claimed in claim 12, further comprising a conductive shield disposed between the first jacket layer and the second jacket layer.

14. The cable as claimed in claim 12, wherein the first jacket layer comprises a first material having a first effective dielectric constant and the second jacket layer comprises a second material having a second effective dielectric constant; and wherein the first effective dielectric constant is lower than the second effective dielectric constant.

15. The cable as claimed in claim 12, wherein the first jacket layer comprises a first material having a first dissipation factor and the second jacket layer comprises a second material having a second dissipation factor; and wherein the first dissipation factor is lower than the second dissipation factor.

16. The cable as claimed in claim 12, further comprising a dielectric element disposed between the first jacket layer and the second jacket layer to create an air gap between the first and second jacket layers.

17. The cable as claimed in claim 16, wherein the dielectric element comprises a helixed spline.

18. The cable as claimed in claim 12, wherein the first jacket layer is bonded to the second jacket layer.

19. The cable as claimed in claim 11, wherein the plurality of protrusions extend away from the inner circumferential surface of the second jacket layer to create an air gap between the first and second jacket layers.

20. The cable as claimed in claim 19, wherein the first jacket layer comprises a first material and the second jacket layer comprises a second; and wherein at least one of an effective dielectric constant and a dissipation factor is lower for the first material than for the second material.

21. The cable as claimed in claim 19, wherein the first jacket layer comprises a foamed material.

22. The cable as claimed in claim 11, wherein the plurality of twisted pairs of insulated conductors and the jacket are helically twisted together with a cable twist lay that is within a range of about 2 to 6 inches.

23. The cable as claimed in claim 11, wherein the plurality of twisted pairs includes four twisted pairs of insulated conductors.

24. The cable as claimed in claim 11, wherein the jacket has a substantially circular cross-sectional shape.

25. The cable as claimed in claim 11, wherein the plurality of inwardly-projecting protrusions extend away from the inner circumferential surface of the inner jacket layer and are configured so as to hold the plurality of twisted pairs away from the inner circumferential surface of the jacket, thereby reducing susceptibility of the plurality of twisted pairs to alien near end crosstalk.

26. The cable as claimed in claim 11, wherein the plurality of inwardly-projecting protrusions extend away from the inner circumferential surface of the inner jacket layer and are configured so as to keep the plurality of twisted pairs away from the inner circumferential surface of the jacket, thereby reducing attenuation of data signals traveling along at least one of the plurality of twisted pairs.

27. A bundled cable comprising:

a plurality of individual cables for data transmission, wherein at least one of the individual cables for data transmission is the cable as claimed in claim 11.

* * * * *